US010814633B2

(12) United States Patent
Yamaguchi et al.

(10) Patent No.: US 10,814,633 B2
(45) Date of Patent: Oct. 27, 2020

(54) LIQUID EJECTION APPARATUS

(71) Applicant: CANON KABUSHIKI KAISHA, Tokyo (JP)

(72) Inventors: Yoshinori Yamaguchi, Yokohama (JP); Hiroshi Nakai, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/107,427

(22) Filed: Aug. 21, 2018

(65) Prior Publication Data

US 2019/0070855 A1 Mar. 7, 2019

(30) Foreign Application Priority Data

Sep. 7, 2017 (JP) ..... 2017-172220

(51) Int. Cl.
*B41J 2/165* (2006.01)

(52) U.S. Cl.
CPC ..... *B41J 2/16511* (2013.01); *B41J 2/16508* (2013.01); *B41J 2/16523* (2013.01); *B41J 2/16544* (2013.01); *B41J 2/16547* (2013.01); *B41J 2/16588* (2013.01)

(58) Field of Classification Search
CPC ..... B41J 2/16511; B41J 2/16544; B41J 2/16547; B41J 2/16588; B41J 2/16508; B41J 2/16523
See application file for complete search history.

(56) References Cited

U.S. PATENT DOCUMENTS

2003/0090535 A1* 5/2003 Park ..... B41J 2/16547 347/29
2019/0009553 A1* 1/2019 Nakai ..... B41J 2/16511

FOREIGN PATENT DOCUMENTS

JP 2010005857 A 1/2010

OTHER PUBLICATIONS

Copending, unpublished U.S. Appl. No. 15/955,005, filed Apr. 17, 2018 to Takahiro Kiuchi et al.
Copending, unpublished U.S. Appl. No. 15/955,813, filed Apr. 18, 2018 to Hiroshi Nakai et al.
Copending, unpublished U.S. Appl. No. 16/024,973, filed Jul. 2, 2018 to Takuya Fukasawa et al.
Copending, unpublished U.S. Appl. No. 16/024,977, filed Jul. 2, 2018 to Hiroshi Nakai et al.
Copending, unpublished U.S. Appl. No. 16/027,552, filed Jul. 5, 2018 to Noriko Sato et al.

* cited by examiner

*Primary Examiner* — Geoffrey S Mruk
(74) *Attorney, Agent, or Firm* — Venable LLP

(57) ABSTRACT

Provided is a liquid ejection apparatus achieving a reduction of the load applied during capping to a moving mechanism of a liquid ejection head or a cap, whichever is pressed. The inkjet ejection apparatus includes: a liquid ejection head that includes an ejection port surface in which ejection ports for ejecting a liquid are provided; a capping unit that caps the ejection port surface; a moving unit that moves the capping unit to a first position at which the capping unit is capable of capping the ejection port surface and to a second position at which the capping unit is separated from the ejection port surface; and a restriction unit that is fixed to a body of the apparatus and, when the capping unit is located at the first position, contacts the capping unit to thereby restrict movement of the capping unit in a direction different from a direction toward the second position.

20 Claims, 15 Drawing Sheets

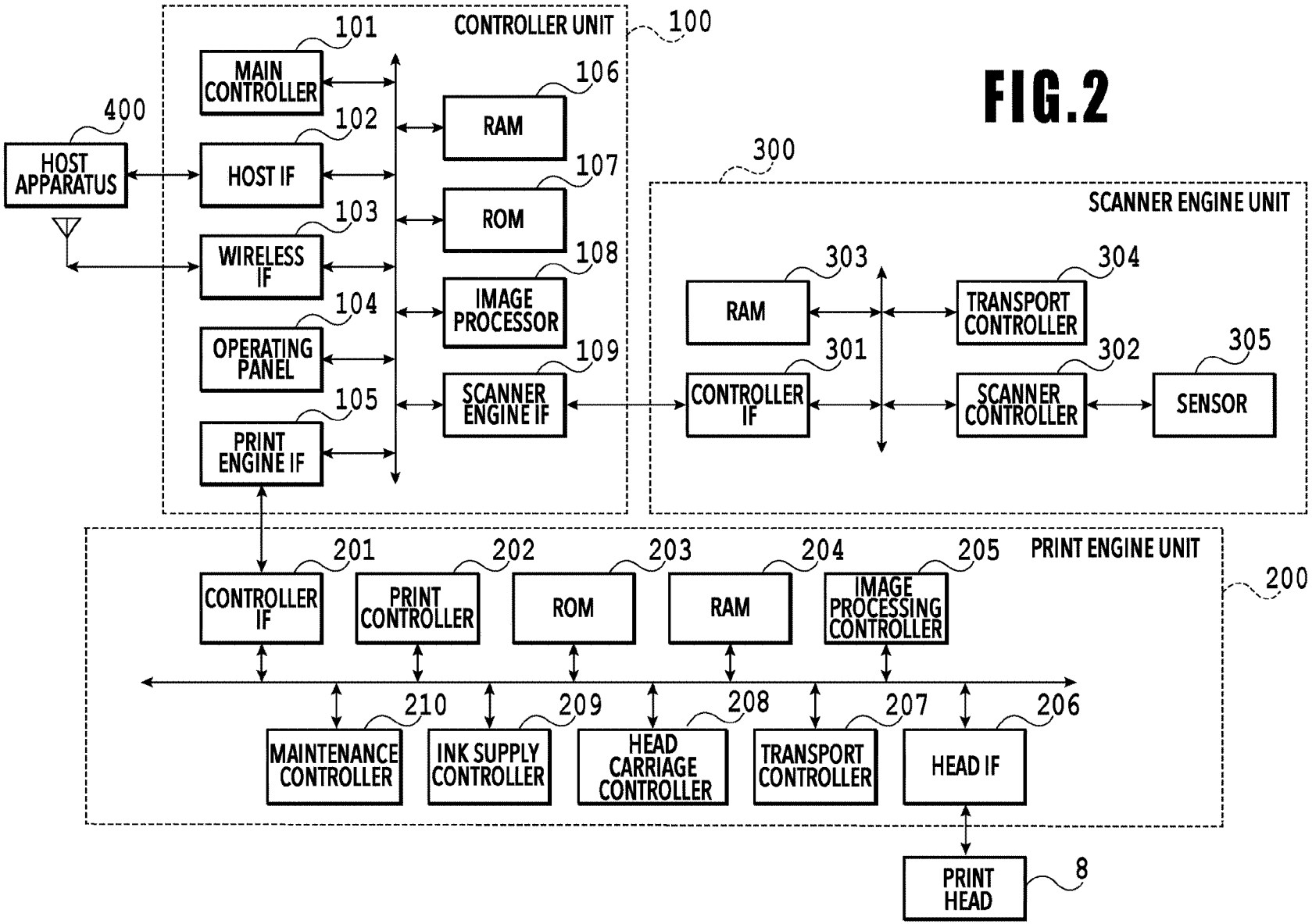
FIG.2
CONTROLLER UNIT
100
MAIN CONTROLLER
101
HOST IF
102
WIRELESS IF
103
OPERATING PANEL
104
PRINT ENGINE IF
105
RAM
106
ROM
107
IMAGE PROCESSOR
108
SCANNER ENGINE IF
109
HOST APPARATUS
400
SCANNER ENGINE UNIT
300
TRANSPORT CONTROLLER
304
SCANNER CONTROLLER
302
SENSOR
305
RAM
303
CONTROLLER IF
301
PRINT ENGINE UNIT
200
CONTROLLER IF
201
PRINT CONTROLLER
202
ROM
203
RAM
204
IMAGE PROCESSING CONTROLLER
205
HEAD IF
206
TRANSPORT CONTROLLER
207
HEAD CARRIAGE CONTROLLER
208
INK SUPPLY CONTROLLER
209
MAINTENANCE CONTROLLER
210
PRINT HEAD
8

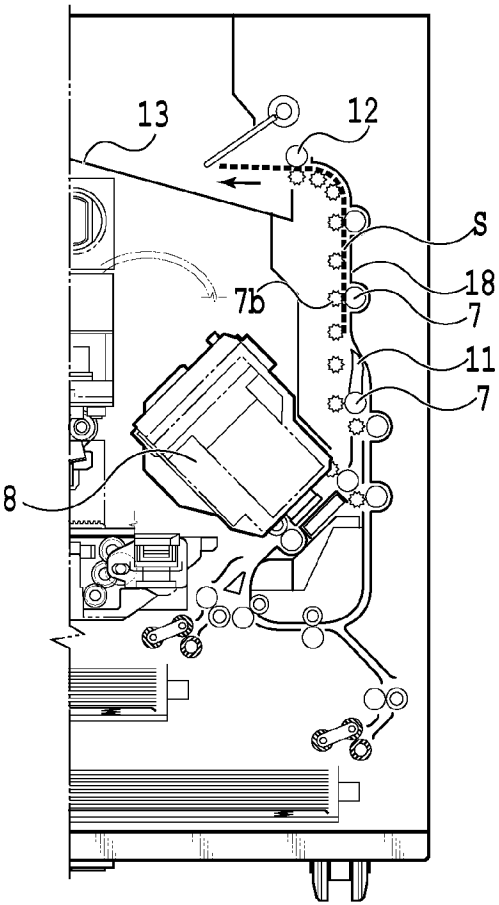
FIG.4C
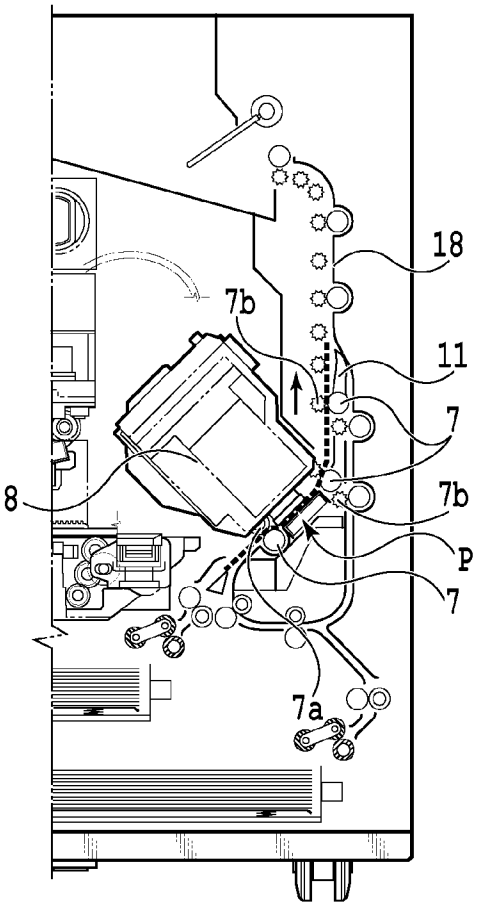
FIG.4B
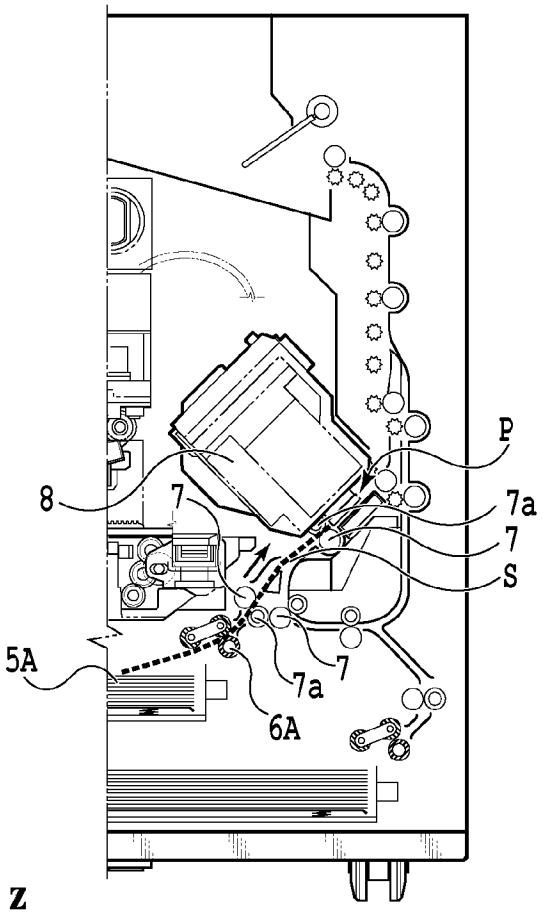
FIG.4A
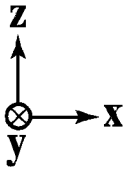

LIQUID EJECTION APPARATUS

BACKGROUND OF THE INVENTION

Field of the Invention

The present invention relates to a liquid ejection apparatus that ejects a predetermined liquid from a liquid ejection head.

Description of the Related Art

Liquid ejection apparatuses such as inkjet printing apparatuses are provided with a cap that protects a print head, or a liquid ejection head. Japanese Patent Laid-Open No. 2010-5857 discloses an inkjet printing apparatus that moves a print head in a horizontal direction to make the print head face a cap and then raises the cap to cap an ejection port surface including ink (liquid) ejection ports.

However, in a configuration as in the inkjet printing apparatus described in Japanese Patent Laid-Open No. 2010-5857, in which the capping is performed by moving both the cap and the print head, at least one of the print head and the cap presses the other during the capping. For this reason, during the capping, a moving mechanism of whichever is pressed is subjected to a load, and such a load may possibly damage the constituent components of the moving mechanism.

SUMMARY OF THE INVENTION

The present invention has been made in view of the above problem and an object thereof is to provide a liquid ejection apparatus that achieves a reduction of the load applied, during capping of a liquid ejection head, to a moving mechanism of the liquid ejection head or a cap, whichever is pressed.

In the first aspect of the present invention, there is provided a liquid ejection apparatus comprising: a liquid ejection head that includes an ejection port surface in which ejection ports for ejecting a liquid are provided; a capping unit that caps the ejection port surface; a moving unit that moves the capping unit to a first position at which the capping unit is capable of capping the ejection port surface and to a second position at which the capping unit is separated from the ejection port surface; and a restriction unit that is fixed to a body of the apparatus and, when the capping unit is located at the first position, contacts the capping unit to thereby restrict movement of the capping unit in a direction different from a direction toward the second position.

In the second aspect of the present invention, there is provided a liquid ejection apparatus comprising: a liquid ejection head that includes an ejection port surface in which ejection ports for ejecting a liquid are provided; a capping unit that caps the ejection port surface; and a rotating unit that moves the capping unit, by rotating of the rotating unit, between a first position at which the capping unit is capable of capping the ejection port surface and a second position at which the capping unit is separated from the ejection port surface while maintaining a surface of the capping unit in a predetermined posture, the surface of the capping unit being a surface to be brought into contact with the ejection port surface when the capping unit is located at the first position.

With the present invention, the load applied to the moving unit by pressure during the capping of the liquid ejection head is reduced.

Further features of the present invention will become apparent from the following description of exemplary embodiments with reference to the attached drawings.

BRIEF DESCRIPTION OF THE DRAWINGS

FIG. 2 is a diagram of a control configuration of the printing apparatus;

FIG. 4A, FIG. 4B, and FIG. 4C are views of a transport path of a print medium fed from a first cassette;

DESCRIPTION OF THE EMBODIMENTS

An embodiment of the present invention will be described below in detail with reference to drawings. Note that the following embodiment does not limit the present invention. Also, not all the combinations of the features described in this embodiment are necessarily essential for the solution to be provided by the present invention. Note that the relative arrangements, the shapes, and so on of the constituent components described in the embodiment are merely exemplary and are not intended to limit the scope of the invention only to those. In the following embodiment, a liquid ejection apparatus including a liquid ejection head that ejects droplets will be described by taking an inkjet printing apparatus as an example.

Figure 1:
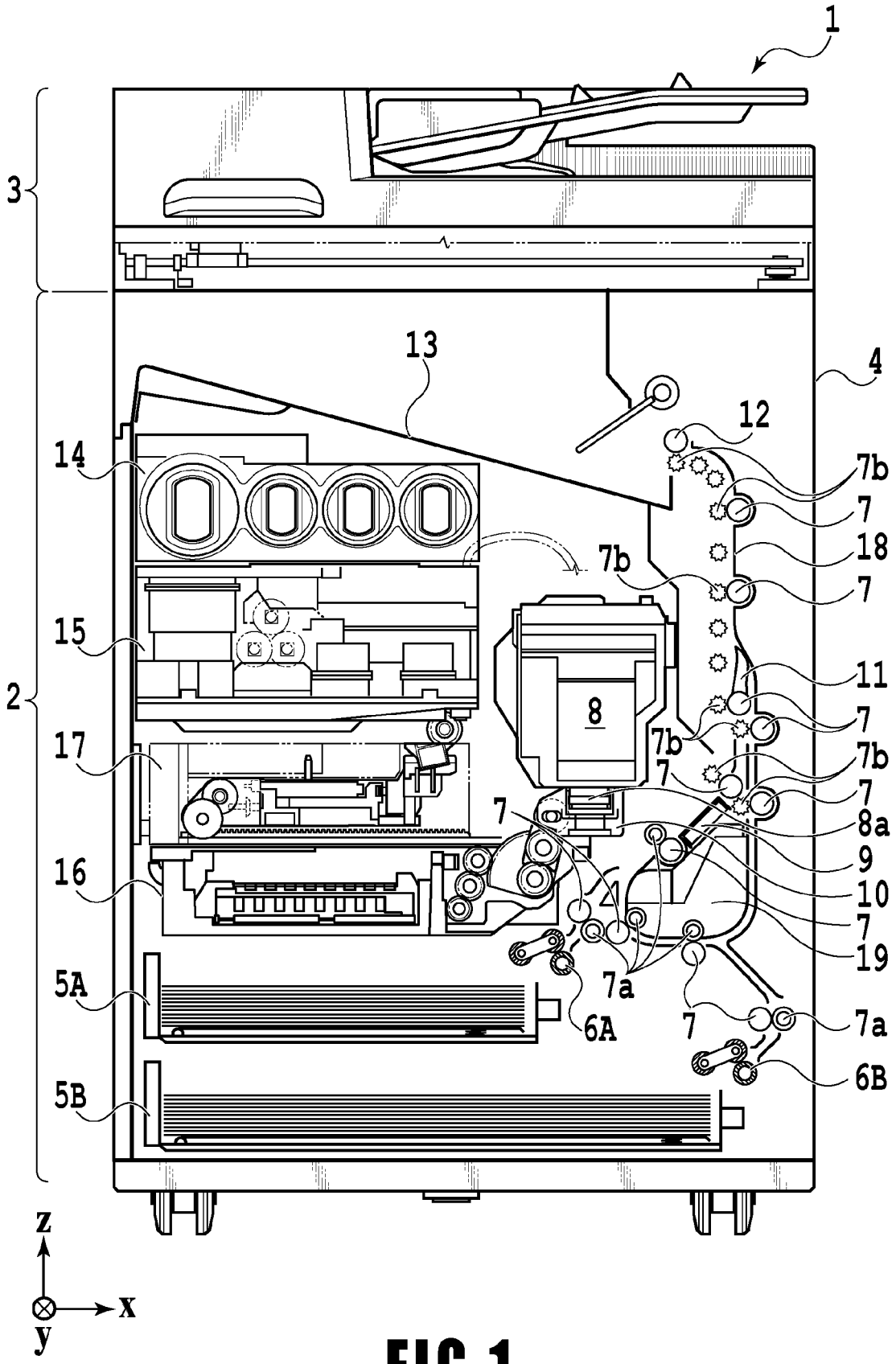
FIG. 1 is a view of a printing apparatus in a standby state.

FIG. 1 is a view of the internal configuration of an inkjet printing apparatus 1 (hereinafter, the printing apparatus 1) used in this embodiment. In FIG. 1, an x direction represents a horizontal direction, a y direction (direction normal to the sheet surface) represents a direction in which ejection ports are aligned in a later-described print head 8, and a z direction represents the vertical direction.

The printing apparatus 1 is a multi-function peripheral including a print section 2 and a scanner section 3 and can perform various processes related to print operations and read operations with the print section 2 and the scanner section 3 individually or in combination with each other. The scanner section 3 includes an automatic document feeder (ADF) and a flatbed scanner (FBS) and can read a document automatically fed by the ADF and read (scan) a document placed on the FBS' document table by the user. Note that although the printing apparatus 1 is a multi-function peripheral including the print section 2 and the scanner section 3 in this embodiment, the printing apparatus 1 may be of a type without the scanner section 3. FIG. 1 illustrates the printing apparatus 1 in a standby state in which it is performing no print operation or read operation.

A first cassette 5A and a second cassette 5B that house print media (cut sheets) S are mounted in an attachable and detachable manner at a bottom portion of the print section 2 on the lower side of a housing 4 in the vertical direction. The first cassette 5A houses relatively small print media of up to a size of A4 in the form of a flat pile. The second cassette 5B houses relatively large print media of a size of up to A3 in the form of a flat pile. Near the first cassette 5A, a first feed unit 6A is provided which separately feeds the housed print media. Likewise, a second feed unit 6B is provided near the second cassette 5B. When a print operation is performed, a print medium S is fed selectively from one of the cassettes.

Transport rollers 7, a discharge roller 12, pinch rollers 7*a*, spurs 7*b*, a guide 18, an inner guide 19, and a flapper 11 are transport mechanisms that guide print media S in predetermined directions. The transport rollers 7 are drive rollers disposed upstream and downstream of the print head 8 and driven by a transport motor not illustrated. The pinch rollers 7*a* are driven rollers that rotate while nipping a print medium S with the transport rollers 7. The discharge roller 12 is a drive roller disposed downstream of the transport rollers 7 and driven by a transport motor not illustrated. The spurs 7*b* transport a print medium S while holding it between themselves and the transport rollers 7 disposed downstream of the print head 8 and the discharge roller 12.

The guide 18 is provided along a transport path for print media S and guides a print medium S in predetermined directions. The inner guide 19 is a member extending in the y direction and having a curved side surface and guides a print medium S along this side surface. The flapper 11 is a member that switches the direction of transport of a print medium S in a two-sided print operation. A discharge tray 13 is a tray on which to place and hold print media S discharged by the discharge roller 12 after completing their print operations.

The print head 8 (liquid ejection head) in this embodiment is a full line-type color inkjet print head, in which a plurality of ejection ports for ejecting inks (liquids) according to print data are aligned along the y direction in FIG. 1, the number of ejection ports corresponding to the width of the print media S. When the print head 8 is at a standby position, an ejection port surface 8*a* of the print head 8 faces vertically downward and is covered by a cap unit 10, as illustrated in FIG. 1. When a print operation is performed, a later-described printer controller 202 changes the posture of the print head 8 such that the ejection port surface 8*a* faces a platen 9. The platen 9 is made of a flat plate extending in the y direction and supports the back surface of a print medium S on which a print operation is to be performed by the print head 8. Movement of the print head 8 from the standby position to a print position will be described later in detail.

An ink tank unit 14 stores inks of four colors to be fed to the print head 8. An ink feed unit 15 is provided at a point along a flow channel connecting the ink tank unit 14 and the print head 8 and adjusts the pressure and flow rate of the inks inside the print head 8 within appropriate ranges. This embodiment employs a circulatory ink feed system. The ink feed unit 15 adjusts the pressure of the inks to be fed to the print head 8 and the flow rate of the inks collected from the print head 8 within appropriate ranges.

A maintenance unit 16 includes the cap unit 10 and a wiping unit 17 and operates them with a predetermined timing to perform a maintenance operation on the print head 8. The maintenance operation will be described later in detail.

FIG. 2 is a block diagram illustrating a control configuration in the printing apparatus 1. The control configuration mainly includes a print engine unit 200 that controls the print section 2, a scanner engine unit 300 that controls the scanner section 3, and a controller unit 100 that controls the whole printing apparatus 1. The printer controller 202 controls various mechanisms of the print engine unit 200 in accordance with instructions from a main controller 101 of the controller unit 100. Various mechanisms of the scanner engine unit 300 are controlled by the main controller 101 of the controller unit 100. Details of the control configuration will be described below.

In the controller unit 100, the main controller 101, configured using a CPU, controls the entire printing apparatus 1 by using a RAM 106 as a work area in accordance with programs and various parameters stored in a ROM 107. For example, upon input of a print job from a host apparatus 400 through a host I/F 102 or a wireless I/F 103, an image processor 108 performs predetermined image processing on received image data in accordance with an instruction from the main controller 101. The main controller 101 then transmits the image data after the image processing to the print engine unit 200 through a print engine I/F 105.

Meanwhile, the printing apparatus 1 may obtain image data from the host apparatus 400 by means of wireless communication or wired communication or from an external storage device (such as a USB memory) connected to the printing apparatus 1. The communication method used for the wireless communication or the wired communication is not particularly limited. For example, Wireless Fidelity (Wi-Fi) (registered trademark) or Bluetooth (registered trademark) can be employed as the communication method used for the wireless communication. Also, universal serial bus (USB) or the like can be employed as the communication method used for the wired communication. Further, for example, upon input of a read command from the host apparatus 400, the main controller 101 transmits this command to the scanner section 3 through a scanner engine I/F 109.

An operation panel 104 is a mechanism with which the user inputs and receives information into and from the printing apparatus 1. Through the operation panel 104, the user can instruct the controller unit 100 to perform operations such as photocopying and scanning, set a print mode, check information on the printing apparatus 1, and so on.

In the print engine unit 200, the printer controller 202, configured using a CPU, controls various mechanisms of the print section 2 by using a RAM 204 as a work area in accordance with programs and various parameters stored in a ROM 203. Upon receipt of various commands and image data through a controller I/F 201, the printer controller 202 temporarily stores them in the RAM 204. The printer controller 202 causes an image processing controller 205 to convert the stored image data into print data so that the print head 8 can use the stored image data in a print operation. After the print data is generated, the printer controller 202 causes the print head 8 to perform a print operation based on the print data through a head I/F 206. In doing so, the printer controller 202 transports a print medium S by driving the feed unit 6A or 6B, the transport rollers 7, the discharge roller 12, and the flapper 11, which are illustrated in FIG. 1, through a transport controller 207. A print process is performed by performing a print operation with the print head 8 in combination with the operation of transporting the print medium S in accordance with instructions from the printer controller 202.

Ahead carriage controller 208 changes the posture and position of the print head 8 in accordance with the operation state of the printing apparatus 1 such as a maintenance state or a print state. An ink feed controller 209 controls the ink feed unit 15 such that the pressure of the inks to be fed to the print head 8 fall within an appropriate range. A maintenance controller 210 controls the operation of the cap unit 10 and the wiping unit 17 of the maintenance unit 16 when a maintenance operation is performed on the print head 8.

For the scanner engine unit 300, the main controller 101 controls hardware resources in a scanner controller 302 by using the RAM 106 as a work area in accordance with programs and various parameters stored in the ROM 107. As a result, various mechanisms of the scanner section 3 are controlled. For example, the main controller 101 controls hardware resources in the scanner controller 302 through a controller I/F 301 such that a document loaded on the ADF by the user is transported through a transport controller 304 and read by a sensor 305. Then, the scanner controller 302 stores the read image data in an a RAM 303. Meanwhile, by converting the image data thus obtained into print data, the printer controller 202 can cause the print head 8 to perform a print operation based on the image data read by the scanner controller 302.

Figure 3:
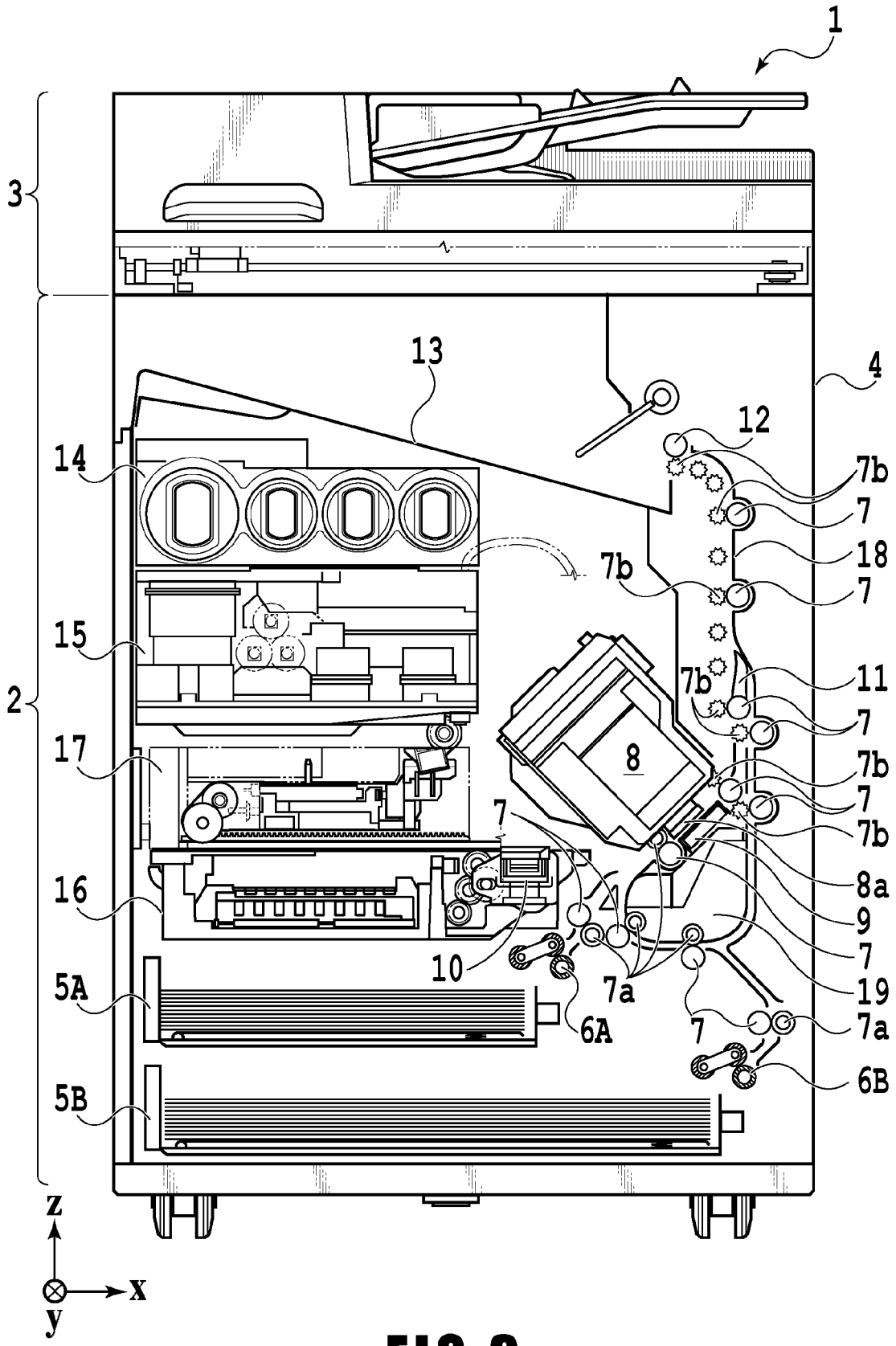
FIG. 3 is a view of the printing apparatus in a printing state.

FIG. 3 illustrates the printing apparatus 1 in a print state. In contrast to the standby state illustrated in FIG. 1, the cap unit 10 is separated from the ejection port surface 8*a* of the print head 8, and the ejection port surface 8*a* is facing the platen 9. In this embodiment, the plane of the platen 9 is tilted at approximately 45 degrees with respect to the horizontal direction, and the ejection port surface 8*a* of the print head 8 at the print position is also tilted at approximately 45 degrees with respect to the horizontal direction so that the distance between the ejection port surface 8*a* and the platen 9 can be kept at a fixed distance.

When the print head 8 is moved from the standby position illustrated in FIG. 1 to the print position illustrated in FIG. 3, the printer controller 202 lowers the cap unit 10 to a retreat position illustrated in FIG. 3 by using the maintenance controller 210. As a result, the ejection port surface 8*a* of the print head 8 is separated from a cap member 10*a*. Then, using the head carriage controller 208, the printer controller 202 turns the print head 8 by 45 degrees while adjusting its height level in the vertical direction, to thereby make the ejection port surface 8*a* face the platen 9. The printer controller 202 performs the reverse of the above steps when moving the print head 8 from the print position to the standby position after a print operation is completed.

Next, the transport paths for print media S in the print section 2 will be described. Upon input of a print command, the printer controller 202 firstly moves the print head 8 to the print position illustrated in FIG. 3 by using the maintenance controller 210 and the head carriage controller 208. The printer controller 202 then drives the first feed unit 6A or the second feed unit 6B based on the print command and feeds a print medium S by using the transport controller 207.

FIG. 4A, FIG. 4B, and FIG. 4C are views illustrating a transport path used in a case of feeding an A4 print medium S stored in the first cassette 5A. The print medium S stacked at the top in the first cassette 5A is separated from the second and lower print media by the first feed unit 6A and transported toward a printing region P between the platen 9 and the print head 8 while being nipped between some transport rollers 7 and pinch rollers 7*a*. FIG. 4A illustrates a transport state immediately before the leading edge of the print medium S reaches the printing region P. The direction of travel of the print medium S is changed from the horizontal direction (x direction) to a direction tilted at approximately 45 degrees with respect to the horizontal direction by the time the print medium S reaches the printing region P after being fed by the first feed unit 6A.

At the printing region P, the inks are ejected toward the print medium S from the plurality of ejection ports provided in the print head 8. The platen 9 supports the back surface of the region of the print medium S to which the inks are to be applied, and the distance between the ejection port surface 8*a* and the print medium S is kept at a fixed distance. After the inks are applied, the print medium S passes the left side of the flapper 11, whose tip is tilted toward the right side, and is transported upward in the vertical direction of the printing apparatus 1 along the guide 18 while being guided by some transport rollers 7 and spurs 7*b*. FIG. 4B illustrates a state where the leading edge of the print medium S has passed the printing region P and is being transported upward in the vertical direction. The direction of travel of the print medium S has been changed to the vertically upward direction by the transport rollers 7 and spurs 7*b* from the position of the printing region P, which is tilted at approximately 45 degrees with respect to the horizontal direction.

After being transported vertically upward, the print medium S is discharged onto the discharge tray 13 by some discharge rollers 12 and spurs 7*b*. FIG. 4C illustrates a state where the leading edge of the print medium S has passed the discharge roller 12 and is being discharged onto the discharge tray 13. The print medium S after being discharged is held on the discharge tray 13 in a state where its surface on which the image was printed by the print head 8 faces down.

Figure 5C:
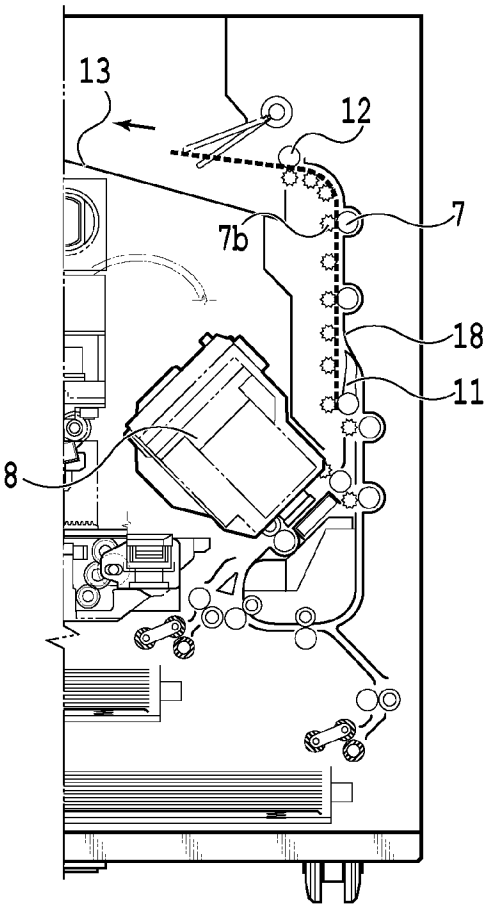
FIG. 5A, FIG. 5B, and FIG. 5C are views of a transport path of a print medium fed from a second cassette.
Figure 5B:
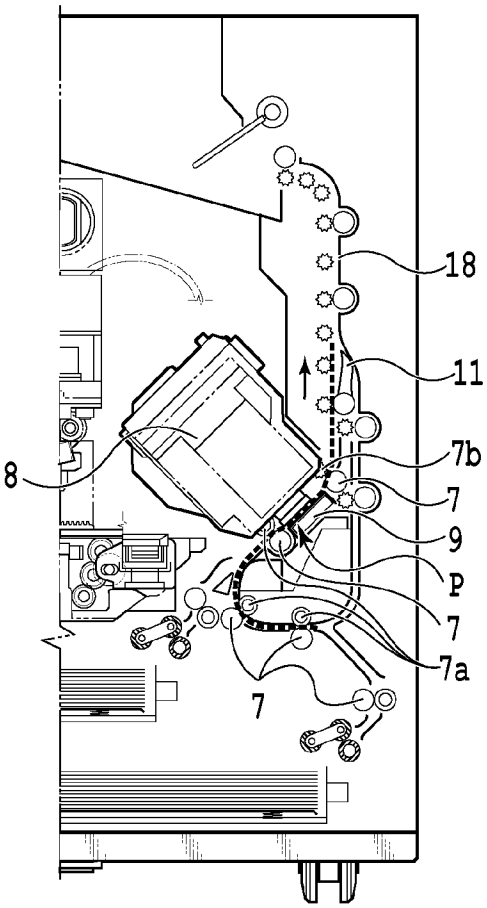
Figure 5A:
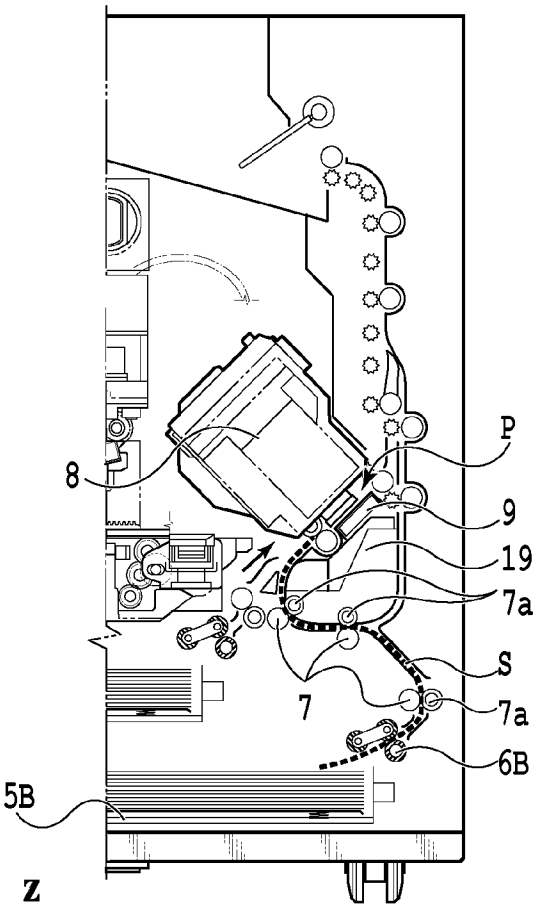

FIG. 5A, FIG. 5B, and FIG. 5C are views illustrating a transport path used in a case of feeding an A3 print medium S stored in the second cassette 5B. The print medium S stacked at the top in the second cassette 5B is separated from the second and lower print media by the second feed unit 6B and transported toward the printing region P between the platen 9 and the print head 8 while being nipped between some transport rollers 7 and pinch rollers 7*a*.

FIG. 5A illustrates a transport state immediately before the leading edge of the print medium S reaches the printing region P. Pluralities of transport rollers 7 and pinch rollers 7*a* and the inner guide 19 are disposed along the transport path from the point at which the print medium P is fed by the second feed unit 6B to the point at which the print medium P reaches the printing region P. Hence, the print medium P is transported to the platen 9 while being curved in an S-shape.

The subsequent part of the transport path is the same as that in the case with an A4 print medium S illustrated in FIG. 4B and FIG. 4C. FIG. 5B illustrates a state where the leading edge of the print medium S has passed the printing region P and is being transported upward in the vertical direction. FIG. 5C illustrates a state where the leading edge of the print medium S has passed the discharge roller 12 and is being discharged onto the discharge tray 13.

FIG. 6A, FIG. 6B, FIG. 6C, and FIG. 6D illustrate a transport path used in a case of performing a print operation on the back surface (second surface) of an A4 print medium S (two-sided printing). In the case of performing two-sided printing, printing is performed on a first surface (front surface) and thereafter a print operation is performed on a second surface (back surface). The transport steps for performing the first surface printing are the same as FIG. 4A, FIG. 4B, and FIG. 4C and description thereof will therefore be omitted here. The transport steps following FIG. 4C will be described below.

Figures 6A, 6B, 6C, 6D:
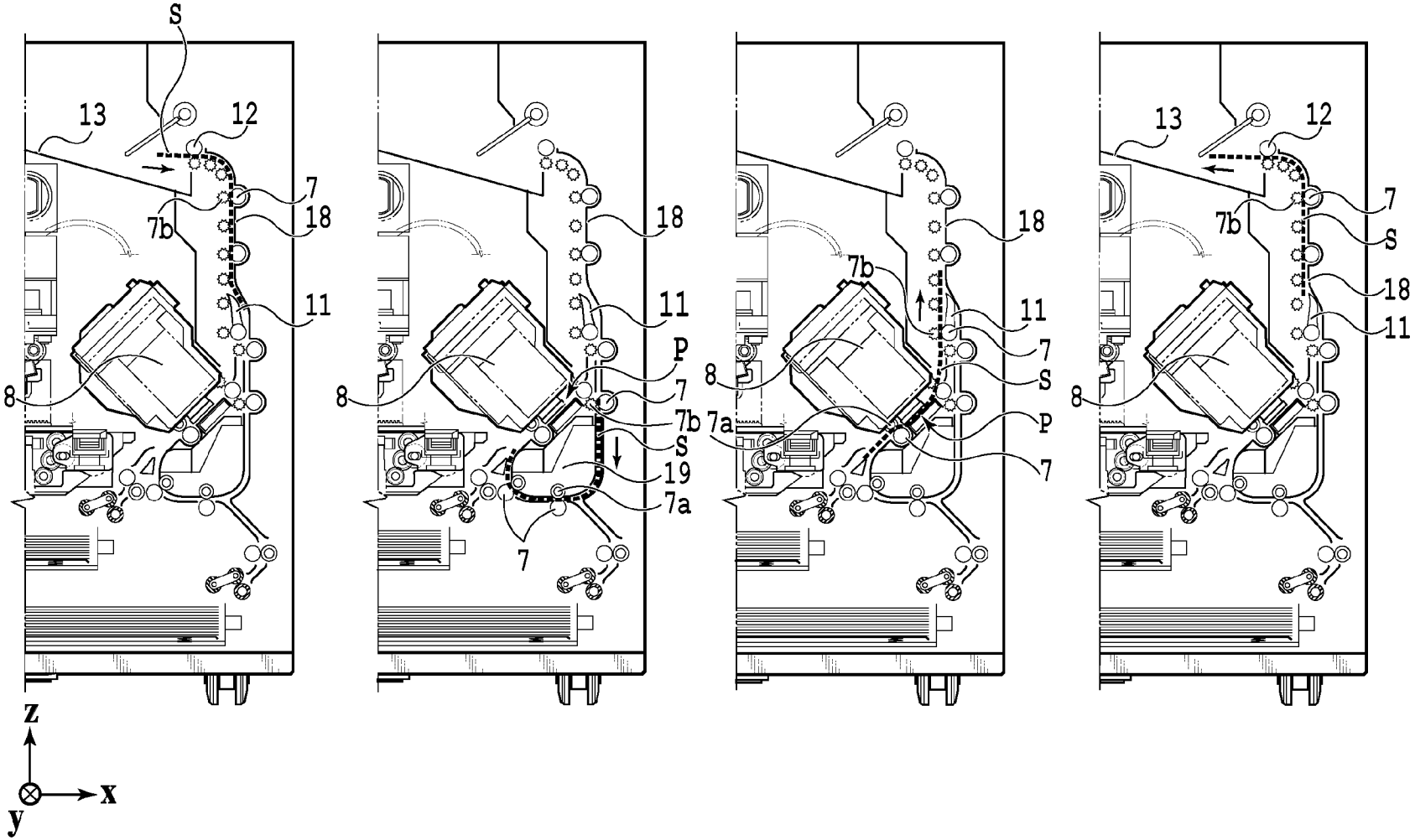
FIG. 6A, FIG. 6B, FIG. 6C, and FIG. 6D are views of a transport path used in a case of performing a printing operation on the back surface of a print medium.

After the print operation on the first surface by the print head 8 is completed and the trailing edge of the print medium S passes the flapper 11, the printer controller 202 rotates the transport rollers 7 in the opposite direction to thereby transport the print medium S to the inner side of the printing apparatus 1. At this moment, the flapper 11 is controlled by an actuator not illustrated such that its tip is tilted toward the left side. Thus, the leading edge of the print medium S (the trailing edge in the print operation on the first surface) passes the right side of the flapper 11 and is transported downward in the vertical direction. FIG. 6A illustrates a state where the leading edge of the print medium S (the trailing edge in the print operation on the first surface) is passing the right side of the flapper 11.

Thereafter, the print medium S is transported along the curved outer circumferential surface of the inner guide 19 and transported to the printing region P between the print head 8 and the platen 9 again. This time, the second surface of the print medium S faces the ejection port surface 8*a* of the print head 8. FIG. 6B illustrates a transport state immediately before the leading edge of the print medium S reaches the printing region P for the print operation on the second surface.

The subsequent part of the transport path is the same as that for the first surface printing illustrated in FIG. 4B and FIG. 4C. FIG. 6C illustrates a state where the leading edge of the print medium S has passed the printing region P and is being transported upward in the vertical direction. At this moment, the flapper 11 is controlled by the actuator not illustrated to move to the position at which its tip is tilted toward the right side. FIG. 6D illustrates a state where the leading edge of the print medium S has passed the discharge roller 12 and is being discharged onto the discharge tray 13.

Next, the maintenance operation on the print head 8 will be described. As also described with reference to FIG. 1, the maintenance unit 16 in this embodiment includes the cap unit 10 and the wiping unit 17 and operates them with a predetermined timing to perform the maintenance operation.

Figure 7:
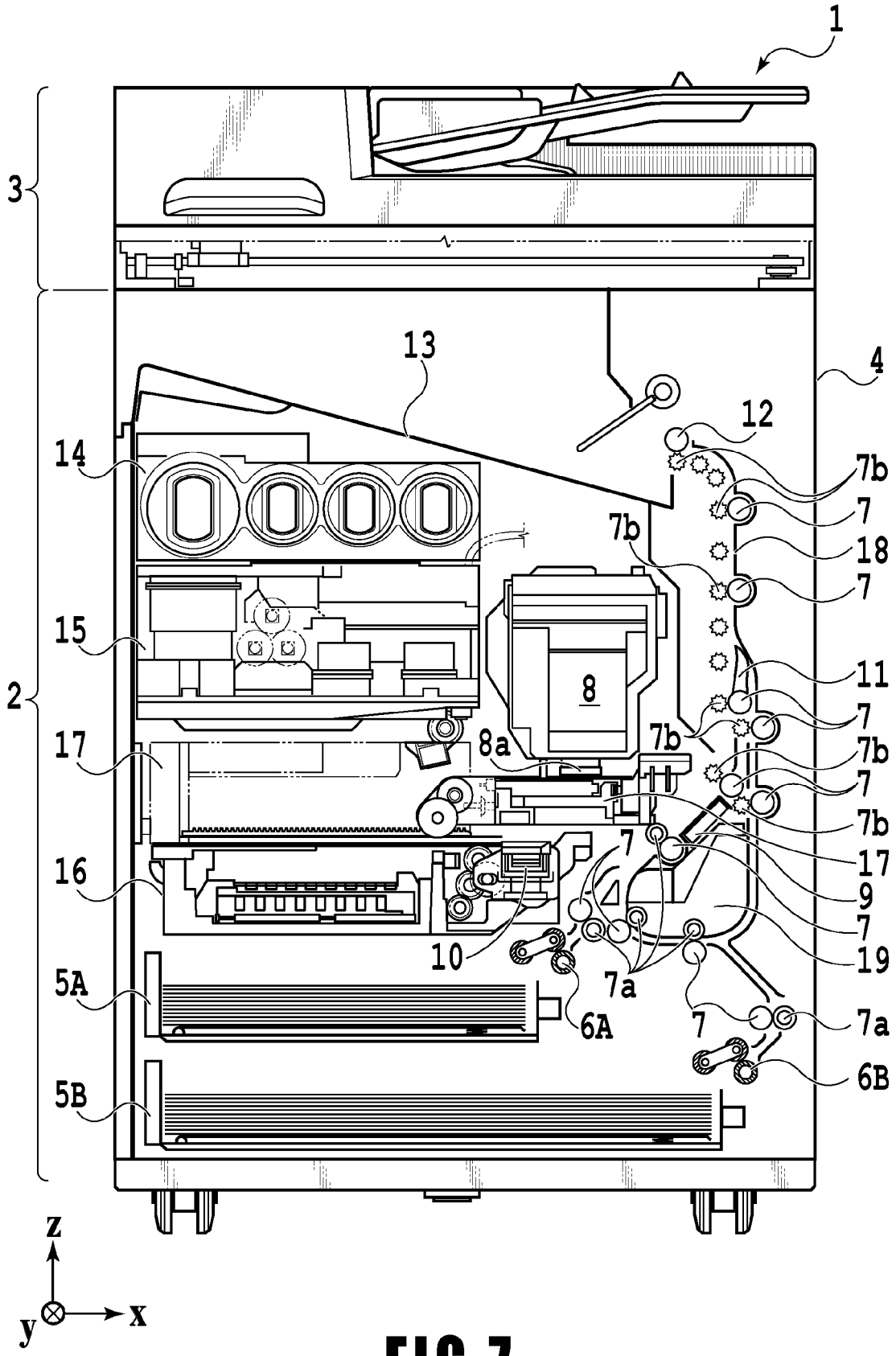
FIG. 7 is a view of the printing apparatus in a maintenance state.

FIG. 7 is a view of the printing apparatus 1 in the maintenance state. To move the print head 8 from the standby position illustrated in FIG. 1 to a maintenance position illustrated in FIG. 7, the printer controller 202 moves the print head 8 upward in the vertical direction and moves the cap unit 10 downward in the vertical direction. The printer controller 202 then moves the wiping unit 17 in the rightward direction in FIG. 7 from its retreat position. The printer controller 202 thereafter moves the print head 8 downward in the vertical direction to thereby move it to the maintenance position, at which the maintenance operation can be performed.

Also, to move the print head 8 from the print position illustrated in FIG. 3 to the maintenance position illustrated in FIG. 7, the printer controller 202 moves the print head 8 upward in the vertical direction while turning it by 45 degrees. The printer controller 202 then moves the wiping unit 17 in the rightward direction from its retreat position. The printer controller 202 thereafter moves the print head 8 downward in the vertical direction to thereby move it to the maintenance position, at which the maintenance operation by the maintenance unit 16 can be performed.

Figure 8A:
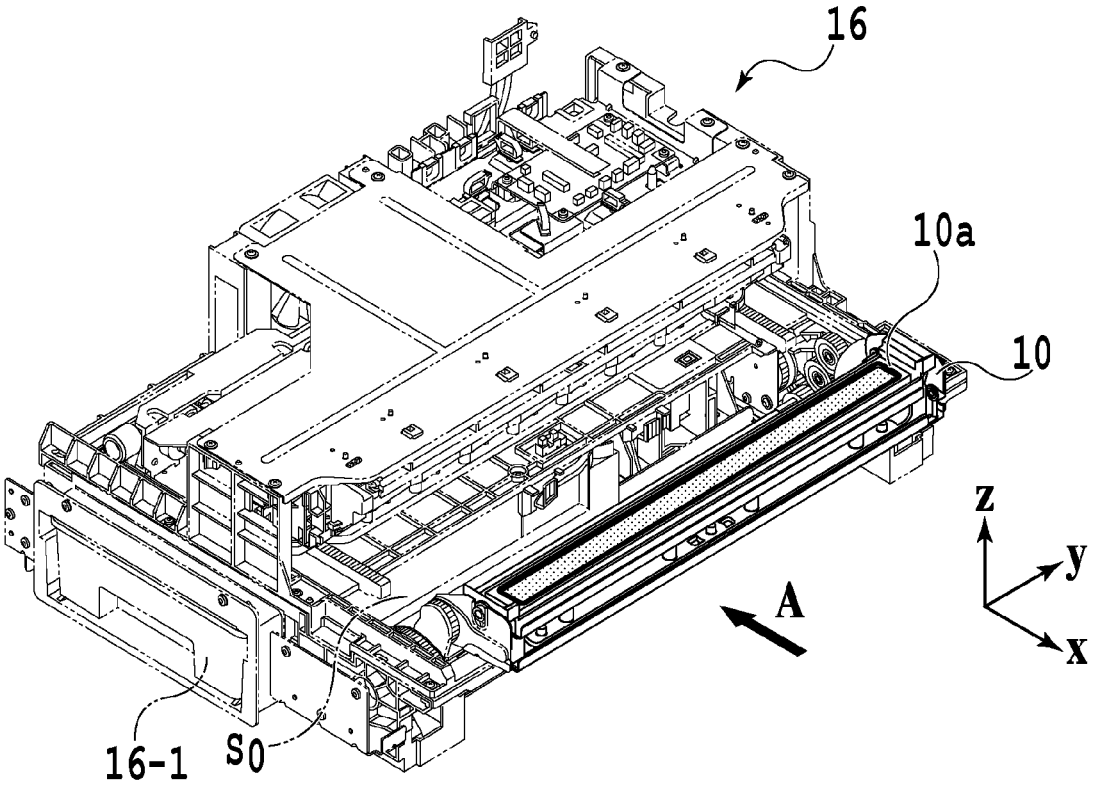
FIG. 8A and FIG. 8B are perspective views illustrating the configuration of a maintenance unit.
Figure 8B:
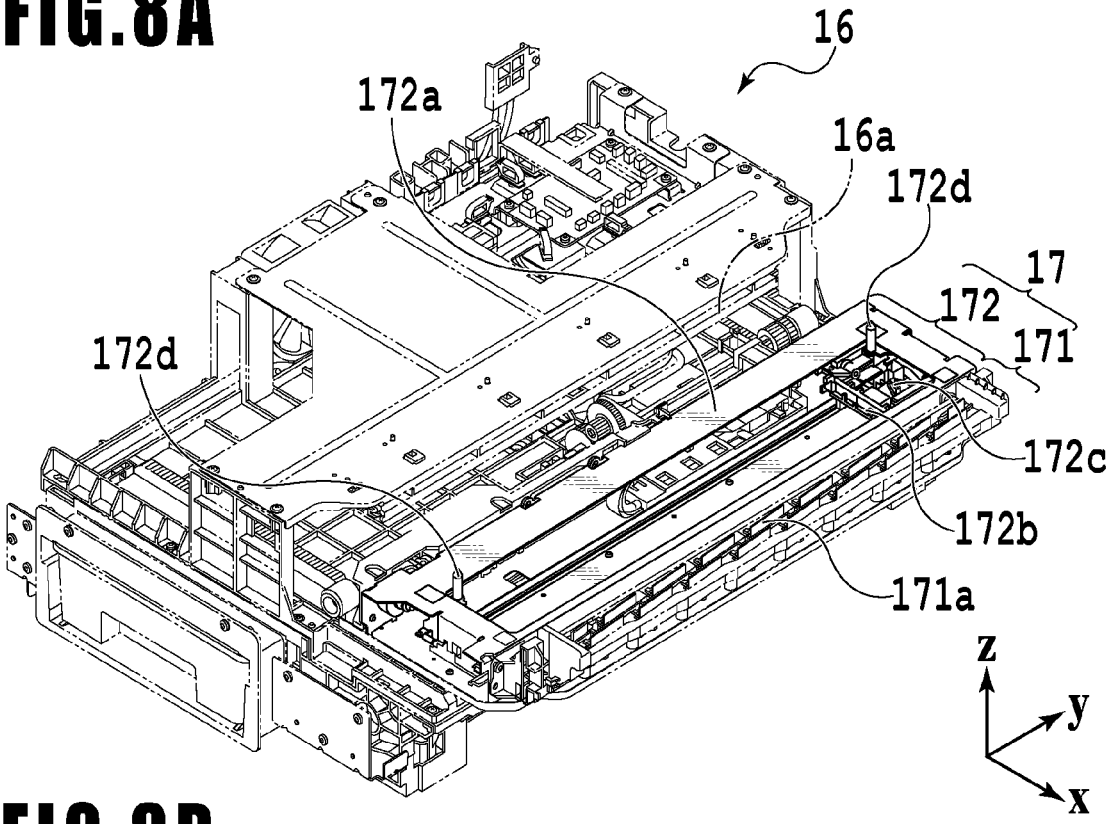

FIG. 8A is a perspective view illustrating the maintenance unit 16 at its standby position. FIG. 8B is a perspective view illustrating the maintenance unit 16 at its maintenance position. FIG. 8A corresponds to FIG. 1, and FIG. 8B corresponds to FIG. 7. When the print head 8 is at its standby position, the maintenance unit 16 is at its standby position illustrated in FIG. 8A and therefore the cap unit 10 is moved upward in the vertical direction and the wiping unit 17 is housed in the maintenance unit 16. The cap unit 10 includes the cap member 10*a*, which is in a box shape extending in the y direction. With this brought into tight contact with the ejection port surface 8*a* of the print head 8, the cap unit 10 can reduce evaporation of the inks through the ejection ports. The cap unit 10 also has a function of collecting the inks ejected onto the cap member 10*a* for preliminary ejection or the like and sucking the collected inks with a suction pump not illustrated.

On the other hand, at the maintenance position illustrated in FIG. 8B, the cap unit 10 is moved downward in the vertical direction and the wiping unit 17 is pulled out of the maintenance unit 16. The wiping unit 17 includes two wiper units, namely a blade wiper unit 171 and a vacuum wiper unit 172.

In the blade wiper unit 171, blade wipers 171*a* that wipe the ejection port surface 8*a* in the x direction are disposed along the y direction over a length corresponding to the region along which the ejection ports are aligned. To perform a wiping operation using the blade wiper unit 171, the wiping unit 17 moves the blade wiper unit 171 in the x direction with the print head 8 positioned at such a height level that the print head 8 can contact the blade wipers 171*a*. With this movement, the blade wipers 171*a* wipe the inks and the like attached to the ejection port surface 8*a*.

At the inlet of the maintenance unit 16 through which the blade wipers 171*a* are housed, a wet wiper cleaner 16*a* is disposed which removes the inks attached to the blade wipers 171*a* and applies a wetting liquid to the blade wipers 171*a*. Each time the blade wipers 171*a* are housed into the maintenance unit 16, the matters attached to the blade wipers 171*a* are removed and the wetting liquid is applied thereto by the wet wiper cleaner 16*a*. Then, the next time the blade wipers 171*a* wipe the ejection port surface 8*a*, the wetting liquid is transferred onto the ejection port surface 8*a*, thereby improving the lubricity between the ejection port surface 8*a* and the blade wipers 171*a*.

On the other hand, the vacuum wiper unit 172 includes a flat plate 172*a* with an opening portion extending in the y direction, a carriage 172*b* capable of moving in the y direction within the opening portion, and a vacuum wiper 172*c* mounted on the carriage 172*b*. The vacuum wiper 172*c* is disposed so as to be capable of wiping the ejection port surface 8*a* in they direction with movement of the carriage 172*b*. At the tip of the vacuum wiper 172*c*, a suction port is formed which is connected to a suction pump not illustrated. Thus, by moving the carriage 172*b* in the y direction with the suction pump actuated, the inks and the like attached to the ejection port surface 8*a* of the print head 8 are wiped by the vacuum wiper 172*c* and sucked into the suction port. In this operation, the flat plate 172*a* and positioning pins 172*d* provided at opposite ends of its opening portion are used to position the ejection port surface 8*a* relative to the vacuum wiper 172*c*.

In this embodiment, it is possible to perform a first wiping process in which the wiping operation by the blade wiper unit 171 is performed but the wiping operation by the vacuum wiper unit 172 is not performed and a second wiping process in which both wiping processes are sequentially performed. To perform the first wiping process, the printer controller 202 first pulls the wiping unit 17 out of the maintenance unit 16 with the print head 8 retreated to above the maintenance position in FIG. 7 in the vertical direction. The printer controller 202 then moves the print head 8 downward in the vertical direction to such a position that the print head 8 can contact the blade wipers 171*a*, and thereafter moves the wiping unit 17 to the inside of the maintenance unit 16. With this movement, the blade wipers 171*a* wipe the inks and the like attached to the ejection port surface 8*a*. Specifically, the blade wipers 171*a* wipe the ejection port surface 8*a* as they are moved from the position to which the wiping unit 17 has been pulled out of the maintenance unit 16 to the inside of the maintenance unit 16.

After housing the blade wiper unit 171, the printer controller 202 moves the cap unit 10 upward in the vertical direction to thereby bring the cap member 10*a* into tight contact with the ejection port surface 8*a* of the print head 8. The printer controller 202 then drives the print head 8 in this state to cause it to perform preliminary ejection, and sucks the inks collected in the cap member 10*a* with the suction pump.

On the other hand, to perform the second wiping process, the printer controller 202 first slides the wiping unit 17 to pull it out of the maintenance unit 16 with the print head 8 retreated to above the maintenance position in FIG. 7 in the vertical direction. The printer controller 202 then moves the print head 8 downward in the vertical direction to such a position that the print head 8 can contact the blade wipers 171*a*, and thereafter moves the wiping unit 17 to the inside of the maintenance unit 16. As a result, the wiping operation by the blade wipers 171*a* is performed on the ejection port surface 8*a*. Subsequently, the printer controller 202 slides the wiping unit 17 to pull it out of the maintenance unit 16 to a predetermined position with the print head 8 retreated to above the maintenance position in FIG. 7 in the vertical direction again. The printer controller 202 then positions the ejection port surface 8*a* and the vacuum wiper unit 172 relative to each other by using the flat plate 172*a* and the positioning pins 172*d* while lowering the print head 8 to the wiping position illustrated in FIG. 7. The printer controller 202 thereafter performs the above-described wiping operation by the vacuum wiper unit 172. The printer controller 202 retreats the print head 8 upward in the vertical direction and houses the wiping unit 17, and then performs preliminary ejection into the cap member and the operation of sucking the collected inks with the cap unit 10, as in the first wiping process.

Next, the configuration of the cap unit 10 in this embodiment will be described in detail with reference to FIG. 9A to FIG. 14B.

Figure 9B:
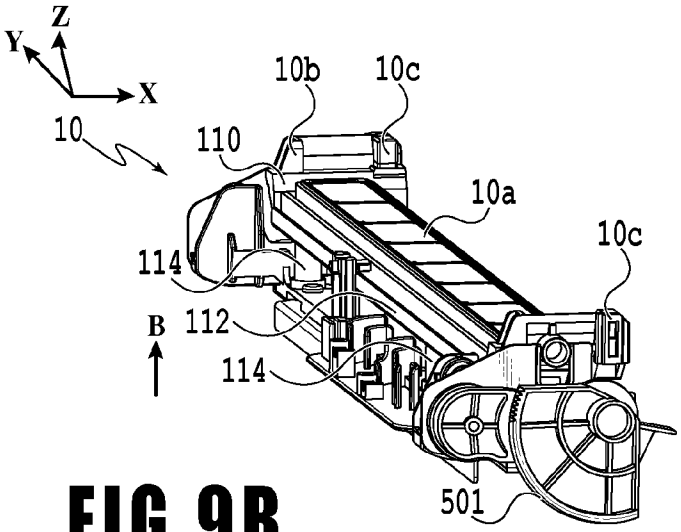
FIG. 9A, FIG. 9B, FIG. 9C, and FIG. 9D are explanatory views schematically explaining the configuration of a cap unit.
Figure 9D:
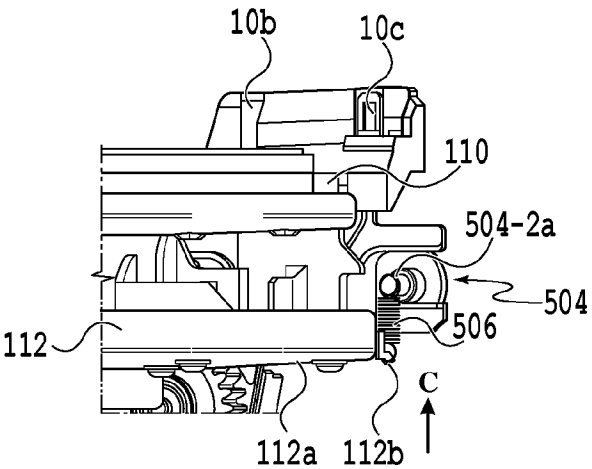
Figure 9A:
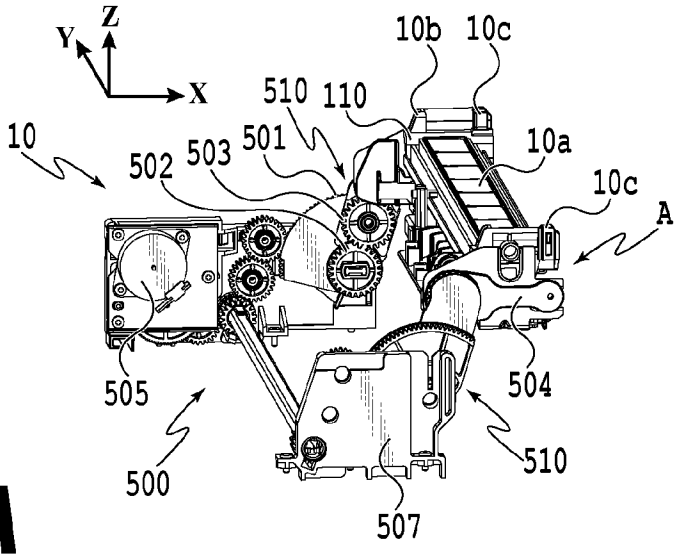
Figure 9C:
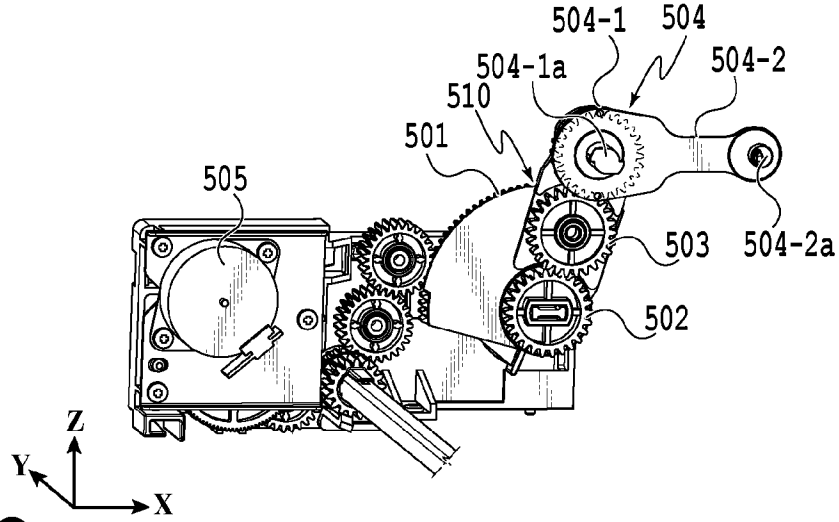

FIG. 9A illustrates an explanatory view of the cap unit at a capping position, and FIG. 9B illustrates an explanatory view of the cap unit 10 at its retreat position. Also, FIG. 9C illustrates an explanatory view of a gear train, and FIG. 9D illustrates an explanatory view of a free-end side of a cap holder gear 504.

As illustrated in FIG. 8A and FIG. 8B, the cap unit 10 is provided so as to be movable along with the wiping unit 17 relative to a mount member 16-1 of the maintenance unit 16. The cap unit 10 is provided at the downstream end of the mount member 16-1 in the x direction. The cap unit 10 includes the cap member 10*a*, which protects (caps) the ejection port surface 8*a* of the print head 8 by coming into tight contact with the ejection port surface 8*a*, and a cap holder 110 which holds the cap member 10*a*. In the cap unit 10, the cap member 10*a* is configured to be movable to the capping position and to the retreat position. The capping position (first position) is a position at which the cap unit 10 faces the ejection port surface 8*a* of the print head 8 and the ejection port surface 8*a* can be capped by the cap member 10*a* by moving the print head 8 downward in the vertical direction. The retreat position (second position) is a position to which the cap unit 10 is retreated from the print head 8, that is, a position at which the cap unit 10 does not interfere with the print head 8 in motion (a position at which the cap unit 10 does not cap the ejection port surface 8*a*). Note that in this embodiment, the retreat position is a position at which the cap member 10*a* is housed in the mount member 16-1 (opening space $S_0$). Specifically, the cap member 10*a* is located at the capping position when the maintenance unit 16 is at its standby position, as illustrated in FIG. 8A, while the cap member 10*a* is located at the retreat position when the maintenance unit 16 is at its maintenance position, as illustrated in FIG. 8B.

The cap unit 10 includes a holding member 112 that holds the cap holder 110, and a rotating unit 500 that moves the cap member 10*a* through the holding member 112 to the capping position and to the retreat position by rotating. Note that in this embodiment, the cap member 10*a* and the cap holder 110 function as a capping unit that moves through the holding member 112 to the capping position and to the retreat position by means of the rotating unit 500 and caps the ejection port surface 8*a*.

At the opposite ends of the cap member 10*a* in the longitudinal direction (y direction), the cap holder 110 is provided with positioning members 10*b* and 10*c* for positioning the cap member 10*a* relative to the ejection port surface 8*a* of the print head 8. The positioning members 10*b* and 10*c* are provided with a predetermined gap left therebetween in the x direction. The cap member 10*a* is positioned relative to the ejection port surface 8*a* by fitting positioning members (not illustrated) provided to the ejection port surface 8*a* between the positioning members 10*b* and 10*c*. Moreover, the holding member 112 is provided with a plurality of biasing members 114, and the cap holder 110 is biased in the direction of arrow B by the biasing members 114. Thus, the cap member 10*a* is biased in the direction of arrow B (upward in the vertical direction) by the biasing member 114 through the cap holder 110.

The holding member 112 extends in the y direction, and the rotating unit 500 is connected to its opposite ends in the longitudinal direction (y direction). Specifically, the cap holder gears 504 (described later) of the rotating unit 500 are provided at the opposite ends of the holding member 112 in the longitudinal direction. Thus, the cap member 10*a* is configured to move through the holding member 112 and so on by means of the rotating unit 500.

The rotating unit 500 (moving unit) includes gear trains 510 each including a sector gear 501, a center gear 502, an idler gear 503, and a cap holder gear 504. These gear trains 510 are provided symmetrically on the front side (the near side of FIG. 9A) and the back side (the far side of FIG. 9A) of the cap unit 10, and the gear trains 510 on the front side and the back side are driven simultaneously by the same drive motor 505.

The sector gear 501 (first gear) and the center gear 502 (second gear) have the same gear center. The sector gear 501 is held on a base member 507 in a rotatable manner whereas the center gear 502 is fixed to the base member 507 in a non-rotatable manner. The cap holder gear 504 (third gear) and the idler gear 503 (fourth gear) are held on the sector gear 501 in a rotatable manner, and the idler gear 503 is in mesh with both the center gear 502 and the cap holder gear 504. Note that the center gear 502 and the cap holder gear 504 have the same gear specification (the same number of teeth).

Thus, as the sector gear 501 rotates, the idler gear 503 in mesh with the center gear 502, which cannot rotate, revolves around the center gear 502 while rotating. In this action, since the center gear 502 and the cap holder gear 504 have the same specification (the same number of teeth), the amount of rotation of the center gear 502 relative to the idler gear 503 and the amount of rotation of the cap holder gear 504 relative to the idler gear 503 are equal. Accordingly, the cap holder gear 504 rotates by the same angle as the angle of the rotation of the sector gear 501 but in the opposite direction. Thus, the orientation of the cap holder gear 504 remains the same irrespective of the angle of the rotation of the sector gear 501.

The cap holder gear 504 holds the holding member 112. Thus, as the sector gear 501 rotates, the cap member 10*a*, held on the holding member 112 through the cap holder 110, rotates about the rotation axis of the sector gear 501 and moves to the capping position or the retreat position. In this action, since the orientation of the cap holder gear 504 remains the same irrespective of the angle of the rotation of the sector gear 501, the holding member 112, held on the cap holder gear 504, also rotates while maintaining its orientation. Specifically, when, for example, the cap member 10*a* is in a substantially horizontal state at the retreat position (see FIG. 3), the cap unit 10 can move to the capping position (see FIG. 1) while maintaining the substantially horizontal state. Therefore, inclination of the cap unit 10 can be controlled, and ink leakage from the cap unit 10 can be suppressed. Further, the substantially horizontal state may be a state of angle that ink leakage from the cap unit 10 can be suppressed.

The cap holder gear 504 includes a gear portion 504-1 where a gear that meshes with the idler gear 503 is formed, and an extension portion 504-2 extending in the x direction from the gear portion 504-1. The gear portion 504-1 is provided with a protrusion 504-1*a* protruding in the y direction at the center of rotation of the cap holder gear 504. This protrusion 504-1*a* fixes either end of the holding member 112 in the longitudinal direction on one end side thereof in the transverse direction of the holding member 112 (x direction). Note that when fixed by the protrusion 504-1*a*, the holding member 112 can rotate by a predetermined amount about the protrusion 504-1*a*. A protrusion 504-2*a* protruding in the y direction is provided on the tip side of the extension portion 504-2, and a later-described spring 506 is connected to this protrusion 504-2*a*. This cap holder gear 504 is disposed such that, for example, the extension portion 504-2 is substantially parallel to the x direction when the cap holder gear 504 is in mesh with the idler gear 503. Note that in the following description, one end side of the holding member 112 in the x direction to which the protrusion 504-1*a* is fixed (upstream side in the x direction) will also be referred to as the fixed-end side while the opposite end side, connected to the protrusion 504-2*a* through the spring 506 (downstream side in the x direction), will also be referred to as the free-end side.

Also, the spring 506 (biasing unit), which biases the free-end side of the holding member 112 upward, is connected to the holding member 112. Specifically, for example, as illustrated in FIG. 9D, one end (upper end) of the spring 506 is connected to the protrusion 504-2*a* while the opposite end (lower end) is connected to a protrusion 112*b* provided on the free-end side of the holding member 112. Further, the free-end side of the holding member 112 is biased in the direction of arrow C by biasing force from the spring 506 such that the holding member 112 can maintain a predetermined posture. Note that the predetermined posture is a posture in which the free-end side of the holding member 112 is tilted to be located higher than the fixed-end side (see FIG. 11B). In this way, the free-end side will not be tilted downward unless a force in the opposite direction (downward direction) from the direction of arrow C is applied to the free-end side. As described above, the fixed-end side of the holding member 112 in the x direction (predetermined direction) is fixed while the free-end side in the x direction (predetermined direction) is biased upward in the vertical direction by the spring 506 such that the free-end side is located higher than the fixed-end side. In this way, it is possible to prevent the free-end side from being tilted downward due to the backlashes in the rotating unit 500, the weight of the holding member 112 (including the members disposed on the holding member 112), and so on. In other words, in this embodiment, the holding member 112 and the spring 506 function as a holding unit that holds the capping unit.

Also, the amount of drive of the drive motor 505 is controlled based on control by the maintenance controller 210. The maintenance controller 210 controls the amount of drive of the drive motor 505 in accordance with instructions from the print controller 202. Note that the cap unit 10 is configured to move the cap member 10*a* by means of a plurality of gears, as described above. Thus, in the above description of the printing state, the standby state, and the wiping process, and so on, "moving the cap unit 10 upward in the vertical direction" means moving the cap unit 10 to move the cap member 10*a* from the retreat position to the capping position. Also, "moving the cap unit 10 downward in the vertical direction" means moving the cap unit 10 to move the cap member 10*a* from the capping position to the retreat position.

As illustrated in FIG. 8A, the cap unit 10 is provided in the maintenance unit 16 such that the cap unit 10 can be housed under a movement region where the wiping unit 17 moves in the x direction. Specifically, in the mount member 16-1, the opening space $S_0$ is formed on a downstream side in the x direction and under the movement region for the wiping unit 17. The cap unit 10 is disposed with the base members 507 fixed in this opening space $S_0$. Moreover, when the cap member 10*a* is at the retreat position, the cap unit 10 is in a state of being housed in the opening space $S_0$ out of contact with the wiping unit 17 moving in the x direction.

Figure 10:
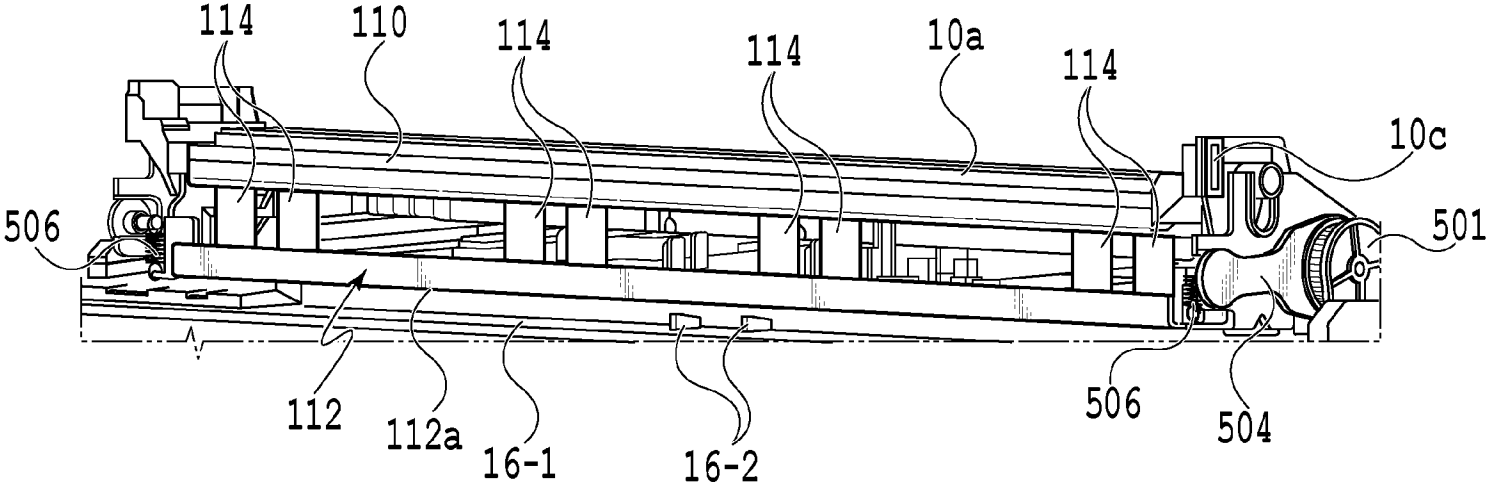
FIG. 10 is a view seen in the direction of arrow A in FIG. 8A.

Here, FIG. 10 illustrates a view seen in the direction of arrow A in FIG. 8A. The mount member 16-1 is provided with a contact member 16-2 vertically under the holding member 112 at the capping position. The contact member 16-2 can contact a lower surface 112*a* of the holding member 112 which is rotated by pressure resulting from ascending and descending operations of the print head 8. Thus, as the cap member 10*a* is pressed downward in the vertical direction by the print head 8, the lower surface 112*a* of the holding member 112 contacts the contact member 16-2 with the ejection port surface 8*a* capped. As a result, the holding member 112 is supported on the contact member 16-2 while also the print head 8 and the cap member 10*a* are positioned in the z direction. In other words, the contact member 16-2 functions as a restriction unit that restricts movement of the holding member 112 by supporting the holding member 112.

Thus, in this embodiment, the capping unit, which includes the holding member 112, is supported by the mount member 16-1, which is fixedly provided on the body of the apparatus, through the contact member 16-2. Accordingly, the load applied to the gears of the rotating unit 500 is small as compared to a case where the holding member 112 is not supported by the mount member 16-1 through the contact member 16-2.

Note that when the cap member 10*a* is pressed downward in the vertical direction by the print head 8, the holding member 112 is rotated against the biasing force from the springs 506 and the ejection port surface 8*a* is capped by the cap member 10*a*. Thus, the predetermined amount by which the holding member 112 can rotate is at least an amount that allows movement from the initial position of the holding member 112 at which the free-end side is located higher than the fixed-end side to the contact position at which the lower surface 112*a* is brought into contact with the contact member 16-2 by pressure from the print head 8. As described above, when capping the print head 8, the cap member 10*a* is in a state of being biased toward the ejection port surface 8*a* by the springs 506. In other words, in this embodiment, the holding unit, including the holding member 112 and the springs 506, has a function of biasing the capping unit (the cap member 10*a* and the cap holder 110) toward the ejection port surface 8*a*.

In this embodiment, as illustrated in FIG. 10, the contact member 16-2 is disposed at two spots at a substantially center position in the direction of extension of the holding member 112 (y direction). However, the present invention is not limited to this. Specifically, the contact member 16-2 may be disposed on the opposite end sides in the direction of extension of the holding member 112. Alternatively, the contact member 16-2 may contact the holding member 112 along a predetermined region extending in the direction of extension of the holding member 112. Still alternatively, the contact members 16-2 may contact the holding member 112 at one spot or three or more spots. Note that the contact member 16-2 is made of an elastic material, for example. Meanwhile, the contact member 16-2 may not be provided, and the lower surface 112*a* of the holding member 112 may directly contact the mount member 16-1, so that the lower surface 112*a* is supported by the mount member 16-1. In other words, the mount member 16-1 functions as the contact member 16-2 in this case.

Figure 11A:
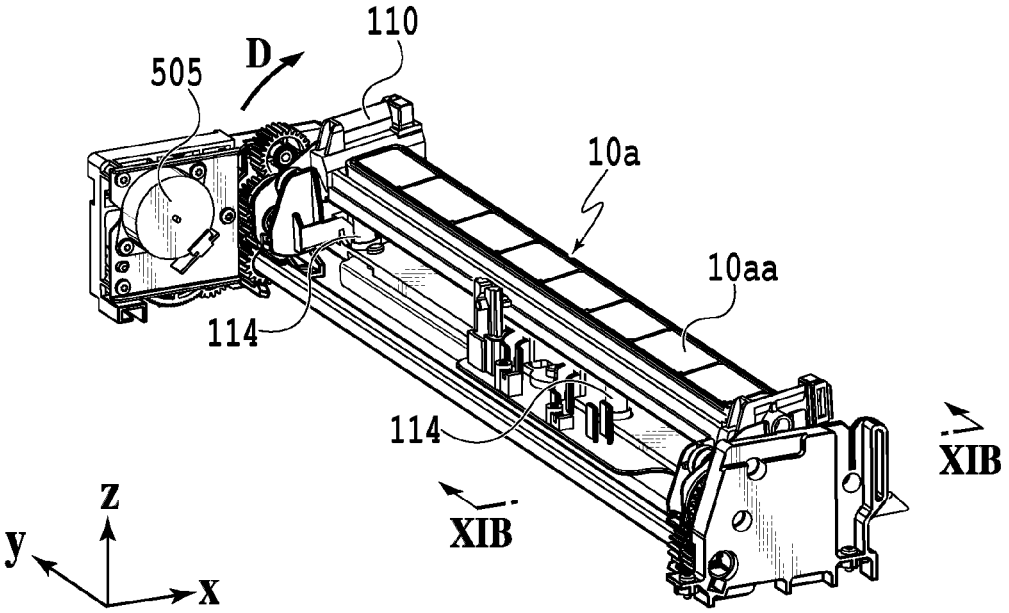
FIG. 11A and FIG. 11B are explanatory views illustrating the cap unit at a retreat position.
Figure 11B:
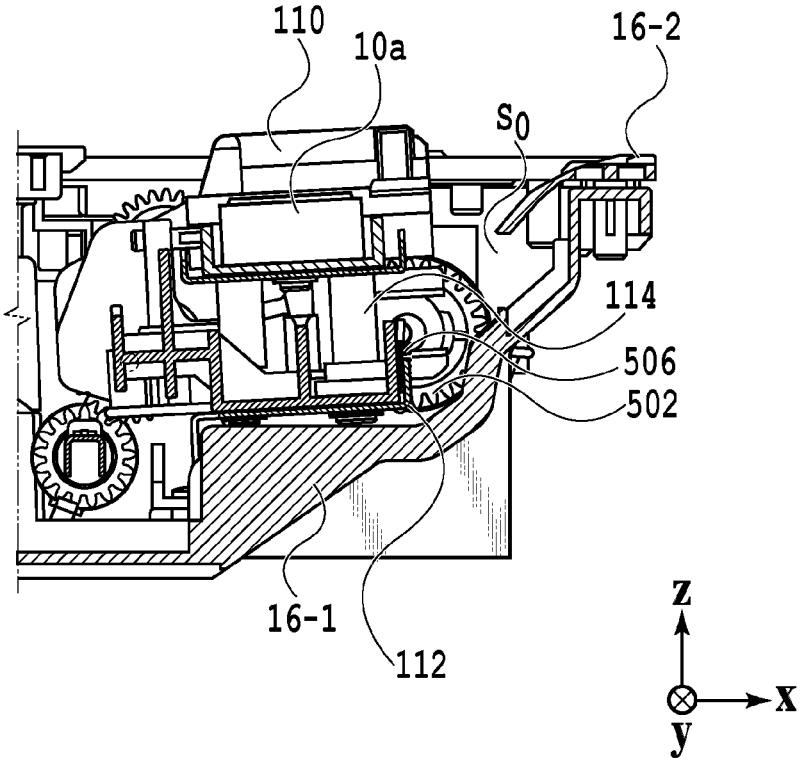
Figure 12A:
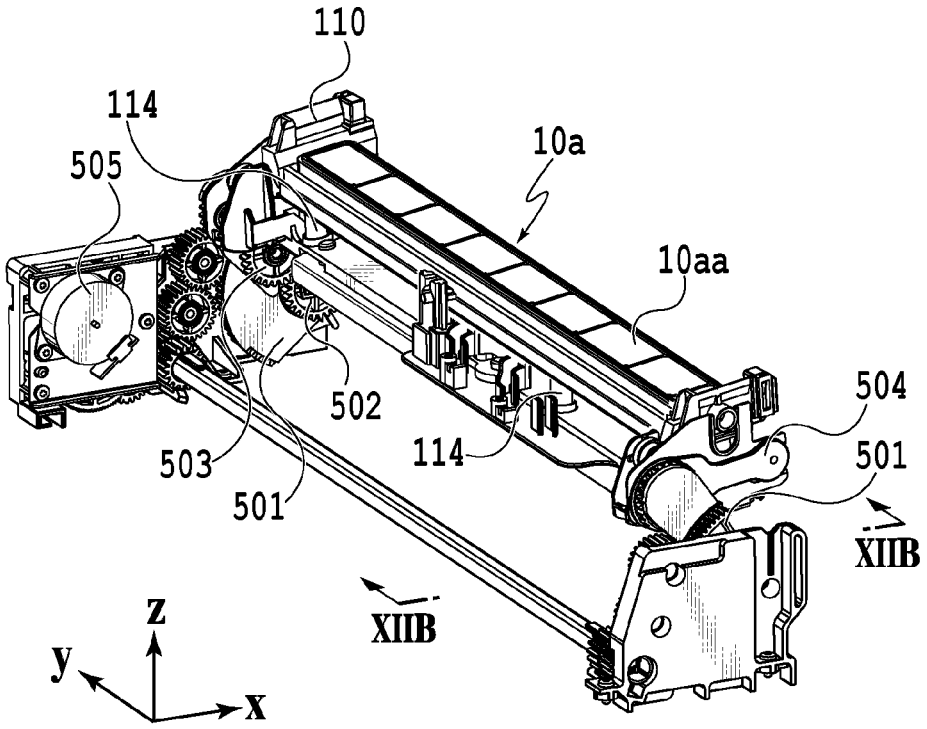
FIG. 12A and FIG. 12B are explanatory views illustrating the cap unit in motion.
Figure 12B:
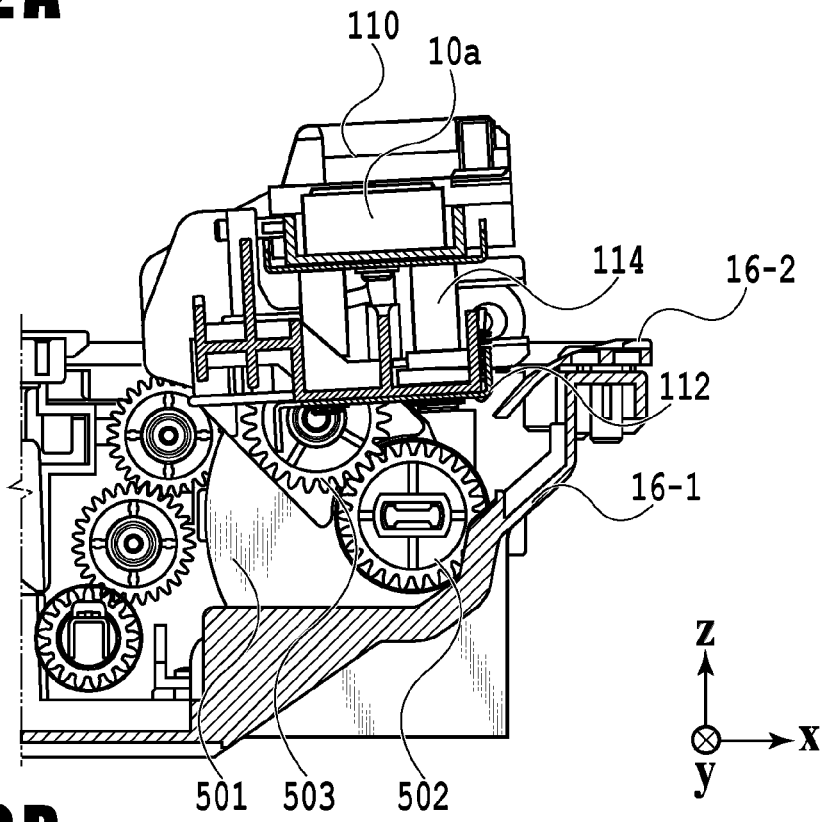
Figure 13A:
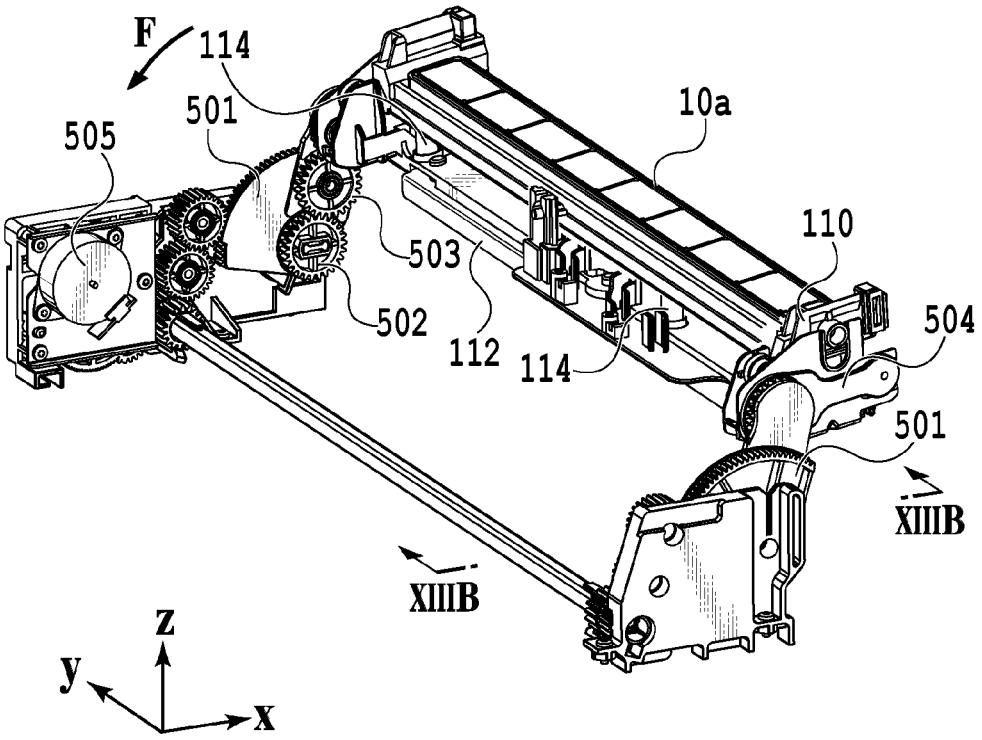
FIG. 13A and FIG. 13B are explanatory views illustrating the cap unit at a capping position.
Figure 13B:
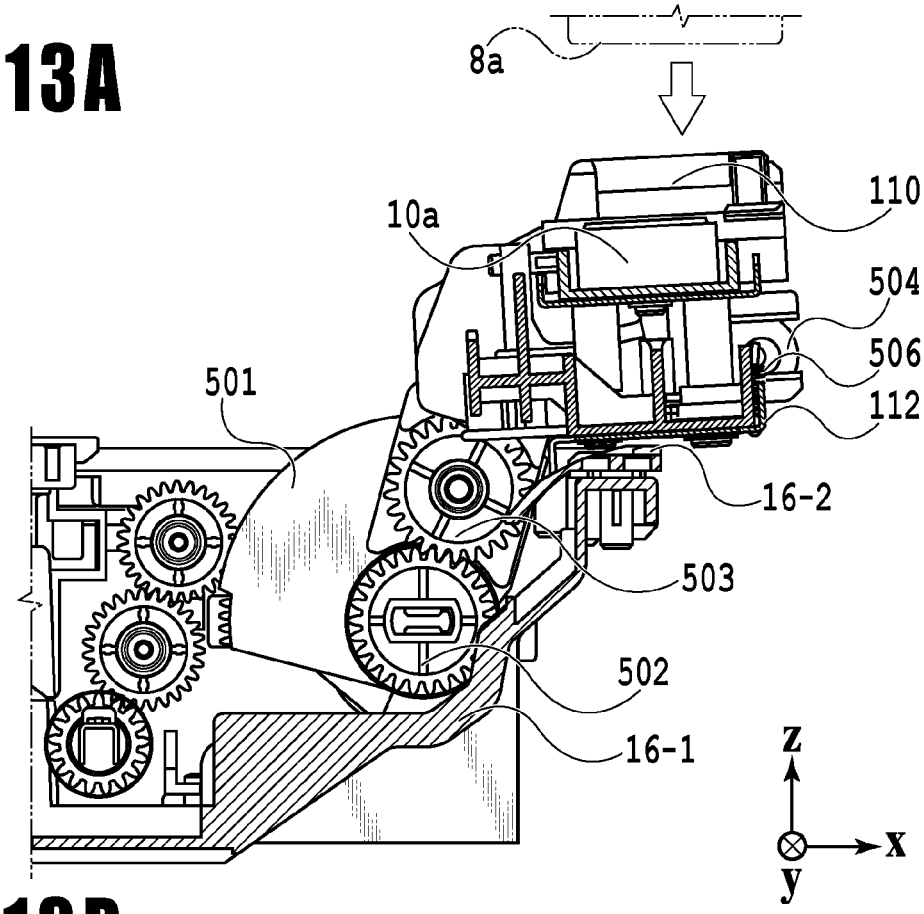
Figure 14A:
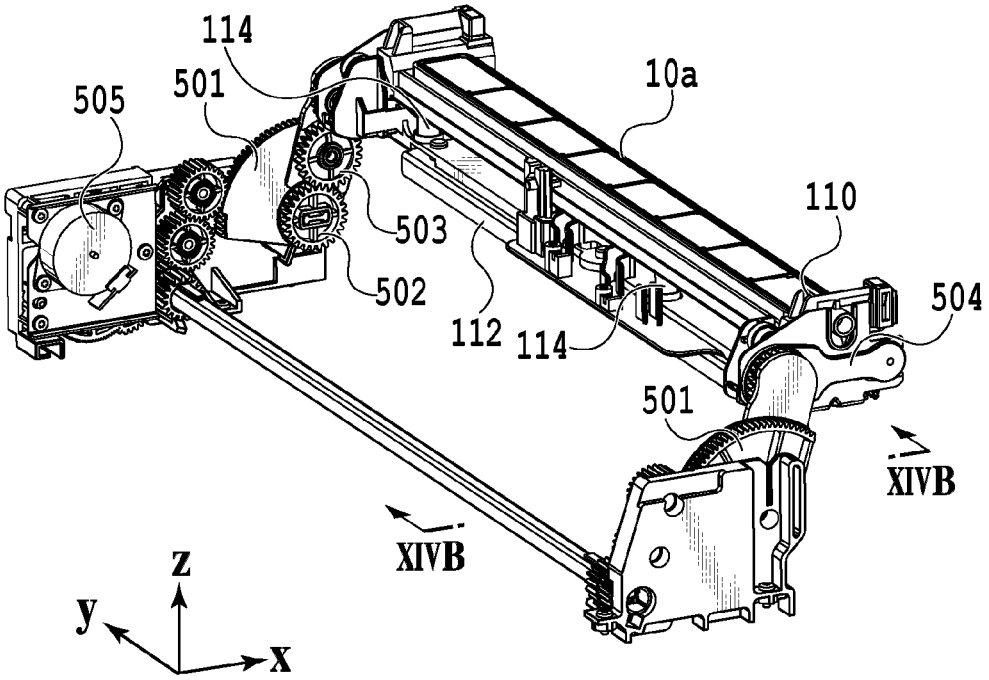
FIG. 14A and FIG. 14B are explanatory views illustrating the cap unit during capping.
Figure 14B:
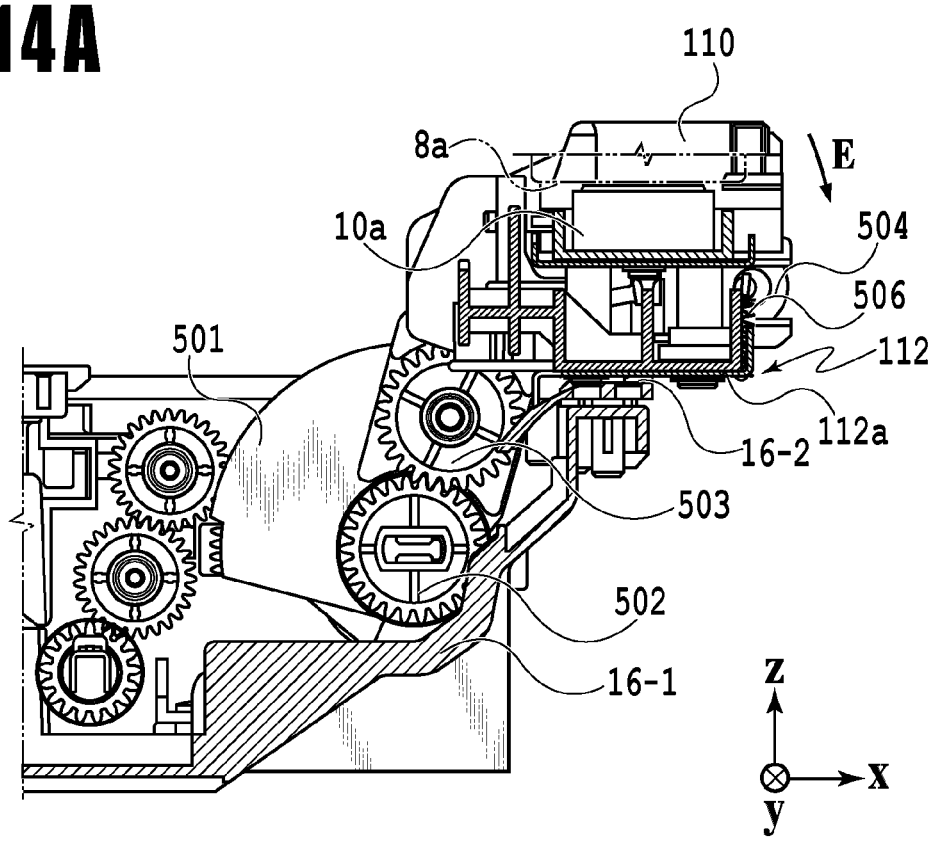

The operation of the cap unit 10 in capping with the above-described configuration will be described. FIG. 11A to FIG. 14B illustrate explanatory views for explaining the operation of the cap unit 10 in capping. FIG. 11A illustrates an explanatory view illustrating the cap unit 10 with the cap member 10*a* at the retreat position, and FIG. 11B illustrates a cross-sectional view taken along line XIB-XIB in FIG. 11A. FIG. 12A illustrates an explanatory view illustrating the cap unit 10 with the cap member 10*a* moving from the retreat position toward the capping position, and FIG. 12B illustrates a cross-sectional view taken along line XIIB-XIIB in FIG. 12A. FIG. 13A illustrates an explanatory view illustrating the cap unit 10 with the cap member 10*a* at the capping position, and FIG. 13B illustrates a cross-sectional view taken along line XIIIB-XIIIB in FIG. 13A. FIG. 14A is an explanatory view illustrating a state where the ejection port surface 8*a* of the print head 8 is capped by the cap member 10*a* at the capping position, and FIG. 14B illustrates a cross-sectional view taken along line XIVB-XIVB in FIG. 14A.

For capping by the cap unit 10 after finishing a printing operation, for example, the print head 8 is moved from the printing position (see FIG. 3) first. Specifically, using the head carriage controller 208, the printer controller 202 turns the print head 8 tilted at 45 degrees with respect to the horizontal direction by 45 degrees while adjusting its height level in the vertical direction, to thereby make the ejection port surface 8*a* face downward in the vertical direction.

Then, using the maintenance controller 210, the print controller 202 drives the drive motor 505 (driving unit) to thereby move the cap member 10*a* in the cap unit 10 from the retreat position to the capping position. Specifically, with the drive motor 505, the print controller 202 rotates each sector gear 501 (see FIG. 12A) in the direction of arrow D (see FIG. 11A) to move the cap member 10*a* at the retreat position to the capping position.

Note that at each gear train 510, including the sector gear 501, the orientation of the cap holder gear 504, holding the holding member 112, remains the same irrespective of the angle of rotation of the sector gear 501. Thus, when the cap member 10*a*, disposed on the holding member 112 through the cap holder 110, is moved from the retreat position to the capping position, the cap member 10*a* is moved while maintaining the predetermined posture (see FIG. 11B and FIG. 12B).

Then, after moving the cap member 10*a* to the capping position (see FIG. 13A), the print controller 202 moves (lowers) the print head 8 downward in the vertical direction by using the head carriage controller 208 to bring the ejection port surface 8*a* into contact with the cap member 10*a*. Note that, as illustrated in FIG. 13B, the cap member 10*a* moved to the capping position is maintaining the same predetermined posture as when the cap member 10*a* is at the retreat position.

As the print head 8 is lowered from above in the vertical direction toward the cap member 10*a* in the predetermined posture at the capping position (see FIG. 14A), the cap member 10*a* contacts the ejection port surface 8*a* firstly from the side adjacent to the free-end side of the holding member 112. Then, as illustrated in FIG. 14B, as the print head 8 is lowered further, the holding member 112 is pressed downward in the vertical direction through the cap member 10*a*, so that the free-end side of the holding member 112 rotates in the direction of arrow E against the biasing force from the springs 506. Thus, the cap member 10*a* comes into tight contact with the ejection port surface 8*a* and, as illustrated in FIG. 14B, the contact member 16-2 comes into contact with the lower surface 112*a* of the holding member 112, thereby positioning the cap member 10*a* in the z direction. As a result, the print head 8 is located at the standby position (see FIG. 1) with the ejection port surface 8*a* capped by the cap member 10*a*.

As described above, during capping, the holding member 112 contacts the holding member 112 and therefore the holding member 112 is supported on the mount member 16-1. Thus, during capping, the load applied to the gears of the rotating unit 500 by the pressure from the print head 8 is reduced. Accordingly, damage to the gears and the like are less likely to occur. Also, when the cap member 10*a* moves from the retreat position to the capping position, the holding member 112 is in a state where the free-end side is located higher than the fixed-end side. This prevents the holding member 112 from interfering with the contact member 16-2 while the cap member 10*a* moves from the retreat position to the capping position, and thereby makes the movement smooth.

Also, when moving the print head 8 from the standby position to the printing position, the print controller 202 moves the print head 8 and the cap unit 10 by using the maintenance controller 210 and the head carriage controller 208. Specifically, first, the print controller 202 turns the print head 8 by 45 degrees while adjusting its height level in the vertical direction, to thereby make the ejection port surface 8*a* face the platen 9. As a result, the ejection port surface 8*a* is separated from the cap member 10*a*. In this action, the free-end side of the holding member 112 is raised by the biasing force from the springs 506, so that the holding member 112 shifts into the predetermined posture, in which the free-end side is located higher than the fixed-end side. Also, in this action, the lower surface 112*a* of the holding member 112 is separated from the contact member 16-2.

Thereafter, the drive motor 505 is driven to rotate the sector gear 501 in the direction of arrow F (see FIG. 13A), thereby moving the cap member 10*a* from the capping position to the retreat position. In this action, the cap member 10*a* moves while maintaining the predetermined posture, and is housed into the opening space $S_0$ while maintaining the predetermined posture (see FIG. 11B and FIG. 12B).

As described above, in the cap unit 10, the capping unit, including the cap member 10*a* and the cap holder 110, is moved between the capping position and the retreat position by the rotating unit 500. Also, the mount member 16-1 of the maintenance unit 16 is provided with the contact member 16-2, which contacts the lower surface 112*a* (second surface) on the opposite side from a first surface of the capping unit that comes into tight contact with the ejection port surface 8*a* during capping. Note that the first surface is a facing surface 10*aa* that faces the ejection port surface 8*a* when the cap member 10*a* is in tight contact with the ejection port surface 8*a* (see FIG. 11A and FIG. 12A).

Thus, when the print head 8 is lowered and the ejection port surface 8*a* is capped by the capping unit, the lower surface 112*a* of the holding member 112 contacts the contact member 16-2 and the capping unit is supported on the contact member 16-2. This reduces the load applied during the capping to each gear train 510 of the rotating unit 500, which moves the capping unit, and therefore prevents damage to the gears constituting the gear train 510. Also, due to the configuration in which the capping unit is moved by rotating of the rotating unit 500, the size can be small in the horizontal direction as compared to a configuration in which the cap is horizontally moved, as in Patent Literature 1, for example.

Also, the center gear 502 is provided in a non-rotatable manner to have the same gear center as the sector gear 501, which is rotated by drive of the drive motor 505. Moreover, there are provided the cap holder gear 504, which is fixed to the sector gear 501 in a rotatable manner and holds the holding member 112, and the idler gear 503, which meshes with the center gear 502 and the cap holder gear 504. Further, the center gear 502 and the cap holder gear 504 have the same gear specification (the same number of teeth). Furthermore, the holding member 112, held by the cap holder gear 504, is biased upward in the vertical direction by the spring 506 so as to cancel the tilt caused by the gravity such that the free-end side is located higher than the fixed-end side.

In this way, the capping unit can move between the retreat position and the capping position while maintaining the above orientation irrespective of the angle of rotation of the sector gear 501. Also, since the holding member 112 moves while maintaining the state in which the free-end side is located higher, the holding member 112 can smoothly move without contacting the contact member 16-2.

Other Embodiments

Note that the above-described embodiment may be modified as described in (1) to (4) below.

(1) In the above embodiment, in the predetermined posture, the free-end side of the holding member 112 is located higher than the fixed-end side. However, the present invention is not limited to this. Specifically, the holding member 112 may lie horizontally or the free-end side may be located lower than the fixed-end side as long as the cap member 10*a* can come into tight contact with the ejection port surface 8*a* of the lowered print head 8 and the holding member 112 does not contact the contact member 16-2 while moving to the retreat position and to the capping position. In other words, the predetermined posture of the holding member 112 may just need to be such an posture that the cap member 10*a* can come into tight contact with the ejection port surface 8*a* of the lowered print head 8 and the holding member 112 does not contact the contact member 16-2 while moving to the retreat position and to the capping position.

Figure 15A:
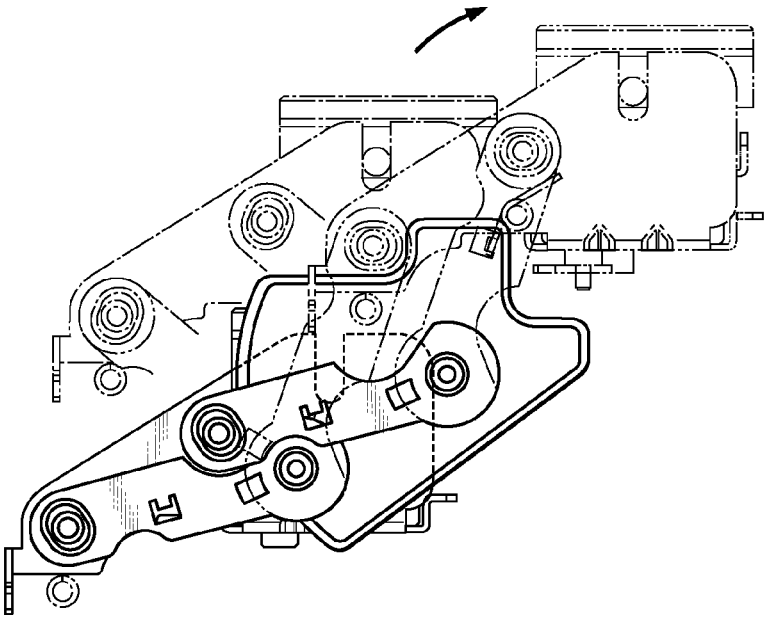
FIG. 15A and FIG. 15B are explanatory views illustrating a modification of a moving mechanism of the cap unit.
Figure 15B:
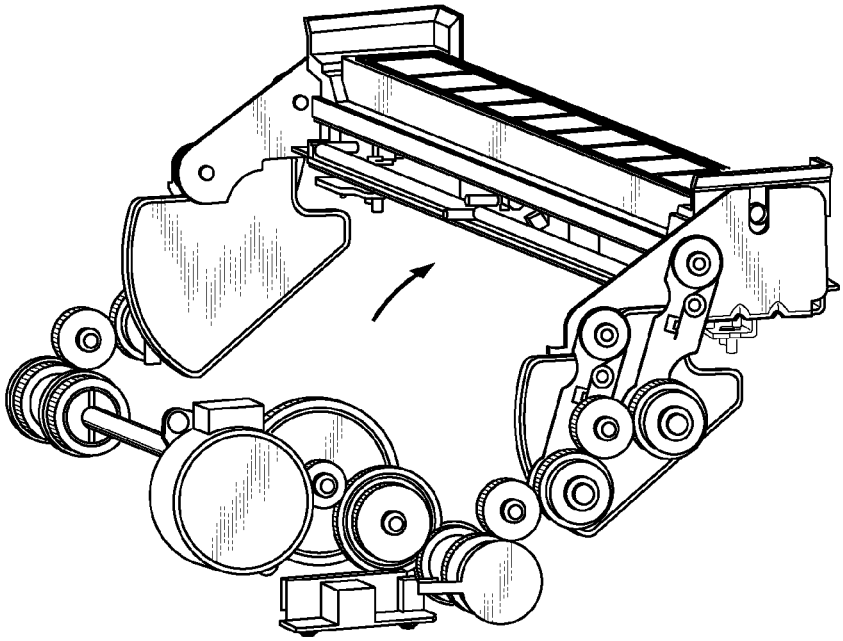

(2) In the above embodiment, the rotating unit 500 includes the gear trains 510 and is configured to be capable of moving the cap member 10*a* between the retreat position and the capping position through their gears. However, the moving mechanism is not limited to this. Specifically, as illustrated in FIG. 15A and FIG. 15B, the configuration may be such that the holding member 112 is supported by a link mechanism, and the cap member 10*a* is moved between the retreat position and the capping position by moving the holding member 112 by means of the link mechanism. In the case of using such a link mechanism, the link mechanism is driven through gears, as illustrated in FIG. 15B, for example.

(3) In the above embodiment, the cap member 10*a* is moved between the retreat position and the capping position about the gear center of the sector gear 501. However, the present invention is not limited to this. Specifically, the capping unit, including the cap member 10*a* and the cap holder 110, may be moved horizontally. Note that in this case, the capping unit may be moved in any manner as long as the configuration is such that the capping unit can be moved between the capping position and the retreat position and the load on the moving mechanism during capping is reduced by the contact member 16-2.

(4) In the above embodiment, the contact member 16-2 is provided to the mount member 16-1 of the maintenance unit 16. However, the present invention is not limited to this. Specifically, the contact member 16-2 may be provided anywhere as long as it is a member that is fixedly provided to the body of the apparatus and can withstand the pressure onto the capping unit from the print head 8.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-172220 filed Sep. 7, 2017, respectively, which are hereby incorporated by reference wherein in their entirety.

What is claimed is:

1. A liquid ejection apparatus comprising:

a liquid ejection head that includes an ejection port surface in which ejection ports for ejecting a liquid are provided, configured to move in a gravitational direction;

a capping unit that caps the ejection port surface;

a moving unit that moves the capping unit to a first position at which the capping unit is capable of capping the ejection port surface and to a second position at which the capping unit is separated from the ejection port surface; and a restriction unit that is fixed to a body of the apparatus and, when the capping unit is located at the first position, contacts the capping unit to thereby restrict movement of the capping unit in a direction different from a direction toward the second position.

2. The liquid ejection apparatus according to claim 1, wherein the restriction unit is provided in a maintenance unit that includes the capping unit and performs a maintenance operation on the liquid ejection head.

3. The liquid ejection apparatus according to claim 2, wherein the maintenance unit includes a wiper unit that wipes the ejection port surface.

4. The liquid ejection apparatus according to claim 1, wherein the moving unit moves the capping unit between the first position and the second position by rotating.

5. The liquid ejection apparatus according to claim 4, wherein the moving unit moves the capping unit while maintaining a surface of the capping unit in a predetermined posture, the surface of the capping unit being a surface to be brought into contact with the ejection port surface when the capping unit is located at the first position.

6. The liquid ejection apparatus according to claim 5, wherein the moving unit is driven through a gear train including a plurality of gears.

7. The liquid ejection apparatus according to claim 6, wherein the gear train includes a first gear that is rotated by drive of a driving unit, a second gear that has a same gear center as the first gear and is provided in a non-rotatable manner, a third gear that is provided on the first gear in a rotatable manner and holds the capping unit, and a fourth gear that is provided on the first gear in a rotatable manner and meshes with the second gear and the third gear, and the second gear and the third gear have a same number of gear teeth.

8. The liquid ejection apparatus according to claim 5, wherein the predetermined posture is a posture that the surface is in a horizontal state.

9. The liquid ejection apparatus according to claim 5, wherein the moving unit moves the capping unit through a link mechanism.

10. The liquid ejection apparatus according to claim 1, further comprising a holding unit that includes a biasing unit and holds the capping unit, the holding unit biasing the capping unit toward the ejection port surface when the capping unit is at the first position.

11. The liquid ejection apparatus according to claim 10, wherein the holding unit is connected and fixed on one end side thereof in a predetermined direction to the moving unit, and includes the biasing unit on an opposite end side in the predetermined direction.

12. The liquid ejection apparatus according to claim 11, wherein the predetermined direction is a longitudinal direction of the holding unit.

13. The liquid ejection apparatus according to claim 1, wherein a plurality of the ejection ports are arranged in an area corresponding to a width of a print medium.

14. The liquid ejection apparatus according to claim 1, wherein the liquid ejection head descends to be capped by the capping unit when the capping unit is located at the first position.

15. A liquid ejection apparatus comprising:

a liquid ejection head that includes an ejection port surface in which ejection ports for ejecting a liquid are provided, the liquid ejection head configured to perform a printing operation;

a capping unit that includes a cap surface configured to cap the ejection port surface; and a rotating unit that rotates the capping unit between a first position in which the cap surface is capable of capping the ejection port surface and a second position in which the cap surface is not capable of capping the ejection port surface while maintaining the cap surface in a predetermined posture.

16. The liquid ejection apparatus according to claim 15, wherein the predetermined posture is a posture that the cap surface is in a horizontal state.

17. The liquid ejection apparatus according to claim 15, further comprising a restriction unit that is fixed to a body of the apparatus and, when the capping unit is located at the first position, contacts the capping unit to thereby restrict movement of the capping unit in a direction different from a direction toward the second position.

18. A liquid ejection apparatus further comprising:

a wiper unit that wipes the ejection port surface when the capping unit is located at the second position.

19. The liquid ejection apparatus according to claim 15, wherein the liquid ejection head performs a printing operation when the capping unit is at the second position.

20. A liquid ejection apparatus comprising:

a liquid ejection head that includes an ejection port surface in which ejection ports for ejecting a liquid are provided, the liquid ejection head configured to perform a printing operation;

a capping unit that includes a cap surface configured to cap the ejection port surface; and a rotating unit that rotates the capping unit between a first position in which the cap surface is capable of capping the ejection port surface and a second position in which the cap surface is not capable of capping the ejection port surface, wherein a posture of the cap surface when the capping unit is located at the first position is same as a posture of the cap surface when the capping unit is located at the second position.

* * * * *